US009951596B2

(12) United States Patent
Lynk

(10) Patent No.: US 9,951,596 B2
(45) Date of Patent: Apr. 24, 2018

(54) SLIDING SLEEVE FOR STIMULATING A HORIZONTAL WELLBORE, AND METHOD FOR COMPLETING A WELLBORE

(71) Applicant: John M. Lynk, Houston, TX (US)

(72) Inventor: John M. Lynk, Houston, TX (US)

(73) Assignee: ExxonMobil Uptream Research Company, Spring, TX (US)

( * ) Notice: Subject to any disclaimer, the term of this patent is extended or adjusted under 35 U.S.C. 154(b) by 217 days.

(21) Appl. No.: 14/827,913

(22) Filed: Aug. 17, 2015

(65) Prior Publication Data

US 2016/0108711 A1 Apr. 21, 2016

Related U.S. Application Data

(60) Provisional application No. 62/064,868, filed on Oct. 16, 2014.

(51) Int. Cl.

| | |
|---|---|
| ***E21B 43/26*** | (2006.01) |
| ***E21B 43/267*** | (2006.01) |
| ***E21B 33/13*** | (2006.01) |
| ***E21B 34/14*** | (2006.01) |
| ***E21B 43/14*** | (2006.01) |

(52) U.S. Cl.

CPC ..... *E21B 43/26* (2013.01); *E21B 33/13* (2013.01); *E21B 34/14* (2013.01); *E21B 43/14* (2013.01); *E21B 43/267* (2013.01)

(58) Field of Classification Search

CPC ..... E21B 34/14
USPC ..... 166/332.4, 334.4, 318
See application file for complete search history.

(56) References Cited

U.S. PATENT DOCUMENTS

| | | | | |
|---|---|---|---|---|
| 4,360,063 | A * | 11/1982 | Kilgore | E21B 23/08 166/313 |
| 4,848,457 | A | 7/1989 | Lilley | |
| 4,880,059 | A | 11/1989 | Brandell et al. | |
| 4,949,788 | A | 8/1990 | Szarka et al. | |
| 4,991,654 | A | 2/1991 | Brandell et al. | |
| 5,090,481 | A | 2/1992 | Pleasants et al. | |
| 5,234,055 | A | 8/1993 | Cornette | |
| 5,253,709 | A | 10/1993 | Kendrick et al. | |
| 5,396,954 | A | 3/1995 | Brooks | |

(Continued)

FOREIGN PATENT DOCUMENTS

| | | |
|---|---|---|
| RU | 2160360 | 12/2000 |

*Primary Examiner* — Sean D Andrish
(74) *Attorney, Agent, or Firm* — ExxonMobil Upstream Research Company—Law Department

(57) ABSTRACT

A method of completing a wellbore involves placing a series of sliding sleeves along a string of production casing in the wellbore and includes dropping a frac ball into the wellbore and landing it on a seat associated with an uppermost sleeve. Pressure is applied to activate the sleeve, open ports along the casing, and fracture a surrounding subsurface formation at a selected zone. Ball sealers are pumped down the well and seated within the sleeve ports. Additional fluid pressure is applied to cause the sleeve to shift further down the well and to release the ball, whereupon the frac ball is pumped to a next lower sleeve. This process may be repeated for multiple sleeves at multiple zones for top-down, multi-stage perforations. A novel sliding sleeve that permits a single ball to be used for activating multiple of the sleeves in series, from heel-to-toe, is also offered.

19 Claims, 23 Drawing Sheets

(56) References Cited

U.S. PATENT DOCUMENTS 5,485,882 A 1/1996 Nierode
5,579,844 A 12/1996 Rebardi et al.
5,704,426 A 1/1998 Rytlewski et al.
5,829,520 A 11/1998 Johnson
5,909,774 A 6/1999 Griffith et al.
6,186,230 B1 2/2001 Nierode
6,325,150 B1 12/2001 Rayssiguier
6,494,256 B1 12/2002 Achee, Jr. et al.
6,513,599 B1 2/2003 Bixenman et al.
6,543,538 B2 4/2003 Tolman et al.
6,575,251 B2 6/2003 Watson et al.
6,581,689 B2 6/2003 Hailey, Jr.
6,601,646 B2 8/2003 Streich et al.
6,644,404 B2 11/2003 Schultz et al.
6,666,274 B2 12/2003 Hughes
6,695,067 B2 2/2004 Johnson et al.
6,749,023 B2 6/2004 Nguyen et al.
6,752,206 B2 6/2004 Watson et al.
6,789,623 B2 9/2004 Hill, Jr. et al.
6,817,410 B2 11/2004 Wetzel et al.
6,830,104 B2 12/2004 Nguyen et al.
6,848,511 B1 2/2005 Jones et al.
6,883,608 B2 4/2005 Parlar et al.
6,907,936 B2 6/2005 Fehr et al.
6,935,432 B2 8/2005 Nguyen
6,957,701 B2 10/2005 Tolman et al.
6,983,796 B2 1/2006 Bayne et al.
6,986,390 B2 1/2006 Doane et al.
6,997,263 B2 2/2006 Campbell et al.
7,044,231 B2 5/2006 Doane et al.
7,051,805 B2 5/2006 Doane et al.
7,055,598 B2 6/2006 Ross et al.
7,059,407 B2 6/2006 Tolman et al.
7,096,945 B2 8/2006 Richards et al.
7,100,691 B2 9/2006 Nguyen et al.
7,104,324 B2 9/2006 Wetzel et al.
7,168,494 B2 1/2007 Starr et al.
7,243,732 B2 7/2007 Richard
7,252,142 B2 8/2007 Brezinski et al.
7,264,061 B2 9/2007 Dybevik et al.
7,343,983 B2 3/2008 Livingstone
7,353,879 B2 4/2008 Todd et al.
7,367,395 B2 5/2008 Vidrine et al.
7,392,852 B2 7/2008 Richard
7,407,007 B2 8/2008 Tibbles
7,431,085 B2 10/2008 Coronado et al.
7,431,098 B2 10/2008 Ohmer et al.
7,441,605 B2 10/2008 Coronado et al.
7,477,160 B2 1/2009 Lemenager et al.
7,516,792 B2 4/2009 Lonnes et al.
7,562,709 B2 7/2009 Saebi et al.
7,575,062 B2 8/2009 East, Jr.
7,584,799 B2 9/2009 Coronado et al.
7,591,321 B2 9/2009 Whitsitt et al.
7,735,559 B2 6/2010 Malone
7,798,236 B2 9/2010 McKeachnie et al.
8,167,047 B2 5/2012 Themig et al.
8,215,411 B2 7/2012 Flores et al.
8,220,542 B2 7/2012 Whitsitt et al.
8,237,585 B2 8/2012 Zimmerman
8,267,177 B1 9/2012 Vogel et al.
8,276,670 B2 10/2012 Patel
8,330,617 B2 12/2012 Chen et al.
8,347,982 B2 1/2013 Hannegan et al.
8,496,055 B2 7/2013 Mootoo et al.
2001/0030049 A1 10/2001 Patel
2002/0007949 A1 1/2002 Tolman et al.
2004/0007829 A1 1/2004 Ross
2004/0035586 A1 2/2004 Gudmestad et al.
2004/0084190 A1 5/2004 Hill et al.
2005/0039917 A1 2/2005 Hailey, Jr.
2005/0039925 A1 2/2005 Connell
2005/0263287 A1 12/2005 Achee, Jr. et al.
2006/0118301 A1 6/2006 East, Jr. et al.
2007/0056750 A1 3/2007 John et al.
2007/0261862 A1 11/2007 Murray
2007/0272411 A1 11/2007 Lopez De Cardenas et al.
2008/0093073 A1 4/2008 Bustos et al.
2008/0125335 A1 5/2008 Bhavsar
2008/0142222 A1 6/2008 Howard et al.
2008/0156496 A1 7/2008 East
2008/0314589 A1 12/2008 Guignard et al.
2009/0032255 A1 2/2009 Surjaatmadja et al.
2009/0078427 A1 3/2009 Patel
2009/0084556 A1 4/2009 Richards et al.
2009/0101334 A1 4/2009 Baser et al.
2009/0159279 A1 6/2009 Assal
2009/0159289 A1 6/2009 Avant et al.
2009/0159298 A1 6/2009 Assal
2009/0211759 A1 8/2009 East, Jr. et al.
2009/0283279 A1 11/2009 Patel et al.
2010/0084134 A1 4/2010 Tulissi et al.
2010/0084146 A1 4/2010 Roberts
2010/0108323 A1 6/2010 Wilkin
2010/0132959 A1 6/2010 Tinker
2010/0139929 A1 6/2010 Rytlewski et al.
2010/0155064 A1 6/2010 Nutley et al.
2011/0048743 A1 3/2011 Stafford et al.
2011/0168403 A1 7/2011 Patel
2011/0192613 A1 8/2011 Garcia et al.
2011/0240316 A1 10/2011 Rondeau
2011/0259595 A1 10/2011 Nguy et al.
2011/0259610 A1 10/2011 Skhurti et al.
2012/0043079 A1 2/2012 Wassouf et al.
2012/0061103 A1 3/2012 Hurtado et al.
2012/0067583 A1 3/2012 Zimmerman et al.
2012/0085548 A1 4/2012 Fleckenstein et al.
2012/0090687 A1 4/2012 Grigsby et al.
2012/0111566 A1 5/2012 Sherman et al.
2012/0199349 A1 8/2012 Themig et al.
2012/0205120 A1* 8/2012 Howell ..... E21B 34/108 166/373
2012/0292053 A1 11/2012 Xu et al.
2013/0000914 A1 1/2013 Kelbie et al.
2013/0008648 A1 1/2013 Lovorn et al.
2013/0025876 A1 1/2013 McCoy et al.
2013/0043043 A1 2/2013 Flores et al.
2013/0075099 A1 3/2013 Kitzman
2013/0105159 A1 5/2013 Alvarez et al.
2013/0161017 A1 6/2013 King
2013/0168099 A1 7/2013 Themig
2013/0199790 A1 8/2013 Themig et al.
2013/0206425 A1 8/2013 Mazyar et al.
2013/0248174 A1 9/2013 Dale et al.
2013/0264063 A1 10/2013 Hallundbaek
2013/0319669 A1 12/2013 DePree et al.
2013/0341014 A1 12/2013 Trummer et al.
2014/0014340 A1 1/2014 King
2015/0285029 A1* 10/2015 Tolman ..... E21B 43/12 166/297

* cited by examiner

SLIDING SLEEVE FOR STIMULATING A HORIZONTAL WELLBORE, AND METHOD FOR COMPLETING A WELLBORE

CROSS REFERENCE TO RELATED APPLICATIONS

This application claims the benefit of U.S. Provisional Patent Application 62/064,868 filed Oct. 16, 2014 entitled "Sliding Sleeve for Stimulating a Horizontal Wellbore, and Method for Completing a Wellbore", the entirety of which is incorporated by reference herein.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

This invention relates generally to the field of wellbore operations. More specifically, the invention relates to a sliding sleeve useful for stimulating a wellbore in connection with fracturing operations. The invention further relates to a completion process wherein zones of a subsurface formation are fractured in stages using a series of novel sliding sleeves.

GENERAL DISCUSSION OF TECHNOLOGY

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with columns of cement. The combination of cement and casing strengthens the wellbore and facilitates the zonal isolation of the formations behind the casing.

It is common to place several strings of casing having progressively smaller outer diameters into the wellbore. A first string may be referred to as surface casing. The surface casing serves to isolate and protect the shallower, fresh water-bearing aquifers from contamination by any other wellbore fluids. Accordingly, this casing string is almost always cemented entirely back to the surface.

A process of drilling and then cementing progressively smaller strings of casing is repeated several times below the surface casing until the well has reached total depth. The final string of casing, referred to as a production casing, is also typically cemented into place. In some completions, the production casing has swell packers spaced across the productive interval. This creates compartments between the swell packers for isolation of zones and specific stimulation treatments. In this instance, the annulus may simply be packed with sand rather than cemented in place.

As part of the completion process, the production casing is perforated at a desired level. This means that lateral holes are shot through the casing and any cement column surrounding the casing. The perforations allow reservoir fluids to flow into the wellbore. In the case of swell packers or individual compartments, the perforating gun penetrates the casing, allowing reservoir fluids to flow from the rock formation into the wellbore along a corresponding zone.

After perforating, the formation is typically fractured at the corresponding zone. Hydraulic fracturing consists of injecting water with friction reducers or viscous fluids (usually shear thinning, non-Newtonian gels or emulsions) into a formation at such high pressures and rates that the reservoir rock parts and forms a network of fractures. The fracturing fluid is typically mixed with a proppant material such as sand, ceramic beads or other granular materials. The proppant serves to hold the fracture(s) open after the hydraulic pressures are released. In the case of so-called "tight" or unconventional formations, the combination of fractures and injected proppant substantially increases the flow capacity of the treated reservoir.

In order to further stimulate the formation and to clean the near-wellbore regions downhole, an operator may choose to "acidize" the formations. This is done by injecting an acid solution down the wellbore and through the perforations. The use of an acidizing solution is particularly beneficial when the formation comprises carbonate rock. In operation, the completion company injects a concentrated formic acid or other acidic composition into the wellbore, and sequentially directs the fluid into selected zones of interest. The acid helps to dissolve carbonate material, thereby opening up porous channels through which hydrocarbon fluids may flow into the wellbore. In addition, the acid helps to dissolve drilling mud that may have invaded the formation.

Application of hydraulic fracturing and acid stimulation as described above is a routine part of petroleum industry operations as applied to individual hydrocarbon-producing formations (or "pay zones"). Such pay zones may represent up to about 60 meters (100 feet) of gross, vertical thickness of subterranean formation. More recently, wells are being completed through a producing formation horizontally, with the horizontal portion extending possibly 5,000, 10,000 or even 15,000 feet.

When there are multiple or layered formations to be hydraulically fractured, or a very thick hydrocarbon-bearing formation (over about 40 meters, or 131 feet), or where an extended-reach horizontal well is being completed, then more complex treatment techniques are required to obtain treatment of the entire target formation. In this respect, the operating company must isolate various zones to ensure that each separate zone is not only perforated, but adequately fractured and treated. In this way the operator is sure that fracturing fluid and proppant are being injected through each set of perforations and into each zone of interest to effectively increase the flow capacity at each desired depth.

The isolation of various zones for pre-production treatment requires that the intervals be treated in stages. This, in turn, involves the use of so-called diversion methods. In petroleum industry terminology, "diversion" means that injected fluid is diverted from entering one set of perforations so that the fluid primarily enters only one selected zone of interest. Where multiple zones of interest are to be perforated, this requires that multiple stages of diversion be carried out.

In order to isolate selected zones of interest, various diversion techniques may be employed within the wellbore. In many cases, mechanical devices such as fracturing bridge plugs, down-hole valves, sliding sleeves (known as "frac sleeves"), and baffle/plug combinations are used.

Sliding sleeves are frequently used in extended reach horizontal wellbores to assist in diversion. In practice, the operator may place sliding sleeves along selected zones of interest in the wellbore. Each sleeve includes a seat, with each sleeve having a progressively smaller seat from top to bottom on the wellbore.

In a typical operation, a small-diameter ball is pumped to the toe of the wellbore. As the ball passes the heel of the wellbore, it travels through a series of larger-diameter ball seats. Once the ball reaches the toe, it is finally stopped by a small-diameter ball seat which it cannot pass. The ball, known as a fracturing ball, will land on this last seat, causing pressure to build up in the wellbore.

As pressure on the final "frac ball" and seat increases from the pumping, a pin along the sleeve is caused to shear. This, in turn, causes the ball seat to shift slightly towards the toe. A sleeve along the production casing will shift with the seat, exposing ports that are open to the surrounding formation. The operator may then inject a hydraulic fracturing fluid under pressure through the exposed ports and into the formation.

After the first hydraulic fracture is formed, an incrementally larger frac ball is pumped down the well. The incrementally larger ball is seated on a corresponding incrementally larger ball seat just up-well of the first ball seat. Pressure builds on this incrementally larger ball seat, causing a new pin in this sleeve to shear. This, in turn, causes the incrementally larger ball seat and sleeve to shift slightly towards the toe, exposing a new set of ports to the wellbore. The operator may then inject a hydraulic fracturing fluid under pressure through the exposed ports and into the surrounding formation adjacent the incrementally-larger seat.

This process of dropping a ball, opening the sleeve, and fracturing the formation is repeated for a series of incrementally-larger balls and seats. This is known as a staged hydraulic fracture stimulation process. A number of service companies manufacture sliding sleeves in this classic configuration, and other configurations, for downhole operations. The sleeves include:

a) the OptiSleeve™ sleeve provided by Weatherford/Lamb, Inc. of Houston, Tex.;
b) the RapidStage™ sleeve and the RapidFrac™ sleeve provided by Halliburton Energy Services, Inc. of Carrollton, Tex.;
c) the OptiPort™ sleeve and the FracPoint™ sleeve provided by Baker Hughes Incorporated of Houston, Tex.;
d) the CS-3™ sleeve and the AS-3™ sleeve provided by Schlumberger Limited of Houston, Tex.;
e) the Packers Plus® sleeve provided by Packers Plus Energy Services Inc. of Calgary, Canada;
f) the iTEC™ sleeve provided by Trican Well Service Ltd. of Calgary, Canada;
g) the T-Frac System sleeve provided by Team Oil Tools, L.P. of The Woodlands, Tex.;
h) the Omega™ sliding sleeve provided by Omega Completion Technology Ltd. of Aberdeen, United Kingdom;
i) the EZ-Port™ sleeve and the Sniper™ Pin-Point sleeve provided by Peak Completion Technologies, Inc. of Calgary, Canada; and
j) the Benoit sliding sleeve provided by Benoit Premium Threading, LLC of Houma, La.

However, the use of these sleeves for horizontal completions carries limitations. First, sleeves and balls have to be arranged and released in the proper size order. This adds a measure of complexity to manufacturing and liner-running operations. Second, because each sleeve gets incrementally smaller, only a finite number of sliding sleeves can be used in a wellbore. The operator is thus limited either in the length of the horizontal completion or the number of zones that get perforated and fractured. Finally, there are case histories of small-diameter frac balls intended to open sleeves at the toe activating larger-diameter frac sleeves at the heel. This generally requires wellbore intervention.

Therefore, a need exists for an improved sleeve, wherein multiple sleeves of the same size may be placed along a wellbore and used for selectively fracturing various zones along production casing. Further, a need exists for a method of fracturing a wellbore at multiple zones wherein a single ball may be repeatedly used along the length of a wellbore for activating a series of sliding sleeves. Finally, a need exists for a completions technique that uses a sleeve that secures ball sealers during staged fracture treatment.

SUMMARY OF THE INVENTION

A sliding sleeve is first provided herein. The sliding sleeve is designed to be used in a wellbore in connection with downhole completion operations. Such completion operations may include the fracture stimulation of a horizontally-oriented wellbore along multiple zones of interest.

The sliding sleeve first includes a tubular housing. The tubular housing has a first end and a second end. Each end is configured to threadedly connect to joints of production casing (including a liner string).

The sliding sleeve also includes one or more ports. The ports are disposed at a location along the tubular housing. Preferably, the ports include ceramic or hardened steel inserts capable of withstanding the flow of sand-laden slurry under conditions of high pressure. In one aspect, the ports are sized to receive a respective ball sealer as part of the fracture stimulation treatment process.

The sliding sleeve further includes a tubular sleeve. The tubular sleeve resides concentrically within a bore of the tubular housing. The tubular sleeve is dimensioned to move from a first end of the tubular housing down partially towards a second end of the tubular housing.

The sliding sleeve comprises a plurality of collett fingers. The fingers extend from a second end of the sliding sleeve. Each collett finger uses a ball seat dog, wherein the collett fingers are biased to collapse into the bore of the tubular housing. In this way a seat is formed for receiving a fracturing ball during a fracture stimulation operation.

The sliding sleeve next includes a first shear pin. The first shear pin secures the tubular sleeve to the tubular housing proximate a first end of the tubular housing. The first shear pin is designed and configured to shear in response to a first degree of hydraulic pressure applied to a ball when the ball has landed on the seat. This, in turn, permits the tubular sleeve to slide along the tubular housing in a direction of the second end of the tubular housing.

The sliding sleeve additionally comprises one or more openings. The openings are placed along the tubular sleeve intermediate the first and second ends of the tubular sleeve. The openings are sized and arranged to reside adjacent the one or more ports when the tubular sleeve slides towards the second end of the tubular housing in response to the first degree of hydraulic pressure.

The sliding sleeve also includes elastomeric seals. The elastomeric seals are disposed within an annular region formed between the tubular sleeve and the surrounding tubular housing. The seals are positioned so that they straddle the one or more openings after the sleeve has been activated. In other words, a seal resides on either side of the openings along the tubular sleeve when the first degree of hydraulic pressure is applied to the ball and seat.

In the sliding sleeve, the ball seat dogs are configured to open and to release the ball from the sliding sleeve. This is in response to a second degree of hydraulic pressure, which is greater than the first degree of hydraulic pressure. The first degree of hydraulic pressure, in turn, is lower than a formation parting pressure in the subsurface formation.

In one embodiment, the sliding sleeve further comprises a second shear pin. The second shear pin resides in the annular region between the sleeve and the surrounding housing. Along with the second shear pin, the sliding sleeve will also include a shear catch, or shoulder. The shoulder resides in the annular region between the sleeve and the surrounding housing. The shoulder is configured to serve as a stop against the second shear pin when the opening along the tubular housing aligns with the ports along the tubular housing. Preferably, the second shear pin is secured to an inner diameter of the tubular housing while the shoulder is secured to an outer diameter of the tubular sleeve.

In one embodiment, the sliding sleeve also includes a recess along an inner diameter of the tubular housing. The recess resides below the ports proximate the second end of the tubular housing. The recess is dimensioned to receive of the ball seat dogs when the dogs are opened in response to the second higher degree of hydraulic pressure. This occurs when the tubular sleeve slides along the tubular housing in response to the second degree of hydraulic pressure.

A method for completing a well in a subsurface formation is also provided herein. The method has benefits in the conducting of oil and gas completion activities. Specifically, a method for completing a well along multiple zones in stages is provided. The method enables the staged fracturing of zones along a wellbore, from top to bottom or from heel to toe.

In one aspect, the method first includes forming a wellbore. The wellbore comprises a bore that extends into a subsurface formation. Preferably, the bore is completed in a horizontal orientation.

The method next includes lining at least a lower portion of the wellbore with a string of production casing. The production casing is made up of a series of steel pipe joints that are threadedly connected, end-to-end, along at least the horizontal portion of the wellbore. The production casing may be, for example, a liner string.

The method further includes placing a series of sliding sleeves along the production casing. Each sliding sleeve has a tubular housing threadedly connected at opposing ends to joints of the production casing. In this way, each sliding sleeve resides along the subsurface formation in series. The sleeves are configured and designed according to the sliding sleeve described above.

The method additionally comprises dropping a fracturing ball into the wellbore. Thereafter, a hydraulic fluid is pumped into the wellbore, thereby causing the ball to land on a seat associated with a first sleeve of the series of sliding sleeves. Preferably, the hydraulic fluid is an aqueous fracturing slurry comprising a proppant.

The method also includes continuing to pump the hydraulic fluid until a tubular sleeve associated with the first sliding sleeve slides. In accordance with the sliding sleeve design described above, this takes place when a first shear pin connecting the tubular sleeve to the tubular housing is sheared under a first degree of hydraulic pressure. Shearing the first shear pin allows the tubular sleeve to slide down the tubular housing in response to fluid pressure applied to the ball. The sleeve slides until a shoulder hits a second shear pin. At this point, the openings along the tubular housing are generally aligned with the one or more ports along the tubular housing. This exposes the ports along the tubular housing of the first sleeve. The operator then pumps the hydraulic fluid through ports in the first sleeve, thereby creating a hydraulic fracture stimulation in the subsurface formation.

The method may further comprise dropping one or more ball sealers into the wellbore. The ball sealers are pumped to corresponding ports, where they are seated and form a sealed pressure vessel.

The method next includes continuing to pump liquid from the surface. This causes a second degree of hydraulic pressure, forcing the second shear pin to shear at the tubular sleeve and allowing the tubular sleeve to further move towards the toe of the wellbore. Of interest, as the tubular sleeve slides along the tubular housing in response to the second degree of hydraulic pressure, the first elastomeric seal covers the one or more ports and the ball sealers residing in the corresponding one or more ports. This prevents the ball sealers from dropping out of the ports during later completion operations.

A biasing force acting against the seat is overcome, allowing the ball to be released through the first sleeve. The fracturing ball is released from the seat, and then drops from the first sleeve and down to a next sleeve in the series of sleeves.

The method also includes pumping additional hydraulic fluid into the wellbore. This causes the ball to land on a seat associated with a second sleeve of the series of sliding sleeves.

The method further comprises continuing to pump the hydraulic fluid into the wellbore. Fluid is pumped under pressure until a tubular sleeve associated with the second sliding sleeve slides. This exposes ports along the tubular housing of the second sleeve to the formation.

The method then includes pumping the hydraulic fluid through the one or more ports in the second sleeve. This creates additional fractures in the subsurface formation. These fractures are in a different zone of interest from the fractures created through the ports associated with the first sleeve. The method then comprises continuing to pump as fluid pressure increases, thereby causing the second seat to release the ball so that the ball drops still further down the wellbore, optionally to a third sleeve in the series of sleeves.

In one optional embodiment, the step of continuing to pump is conducted after recognizing a condition of screen-out while pumping the hydraulic fluid through the ports in the first sleeve. The condition of screen-out is remediated by the step of exposing ports along the tubular housing of the second sleeve.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

FIG. 1A presents a wellbore having been lined with a string of production casing. Annular packers are placed along the wellbore to isolate selected subsurface zones. The zones are identified as "A," "B" and "C."

FIG. 1B shows Zone A having been perforated. Further, fractures have been formed in the subsurface formation along Zone A using any known hydraulic fracturing technique.

FIG. 1C shows that a plug has been set adjacent a packer intermediate Zones A and B. Further, a perforating gun is shown forming perforations along Zone B.

FIG. 1D shows that a fracturing fluid being pumped into the wellbore, with artificial fractures being induced in the subsurface formation along Zone B.

FIG. 1E shows that ball sealers have been dropped into the wellbore, thereby sealing perforations along Zone B. Further, a perforating gun is now indicated along Zone C. The casing along Zone C has been perforated.

FIG. 1F shows fracturing fluid being pumped into the wellbore. Artificial fractures have been induced in the subsurface formation along Zone C.

FIG. 2A presents a wellbore having been lined with a string of production casing. Annular packers are placed along the wellbore to isolate selected subsurface zones. The zones are identified as "A," "B" and "C."

FIG. 2B shows that a ball has been dropped onto a fracturing sleeve in Zone A.

FIG. 2C shows that hydraulic pressure has been applied to open the fracturing sleeve in Zone A by pumping a fracturing fluid into the wellbore. Further, fractures are being induced in the subsurface formation along Zone A. Proppant is seen residing now in an annular region along Zone A.

FIG. 2D shows that a second (and larger) ball has been dropped. The ball has landed on a fracturing sleeve in Zone B.

FIG. 2E shows that hydraulic pressure has been applied to open the fracturing sleeve in Zone B by pumping a fracturing fluid into the wellbore. Further, fractures are being induced in the subsurface formation along Zone B. Proppant is seen residing now in an annular region along Zone B.

FIG. 2F shows that a third (and still larger) ball has been dropped. The ball has landed on a fracturing sleeve in Zone C. Zone C is ready for treatment.

FIG. 3A presents a wellbore having been lined with a string of production casing. Annular packers are placed along the wellbore to isolate selected subsurface zones. The zones are again identified as "A," "B" and "C."

FIG. 3B shows Zone A having received a perforating gun. A plug has been run into the wellbore with the perforating gun. Zone A has been perforated.

FIG. 3C shows that fractures are being formed in the subsurface formation along Zone A using a fracturing fluid. Proppant is seen residing now in an annular region along Zone A. Additionally, ball sealers and a perforating gun are being simultaneously run into the wellbore in anticipation of treating Zone B.

FIG. 3D shows that the perforating gun of FIG. 3C has been placed along Zone B. Fractures have been formed in Zone B. Simultaneously, a fracturing fluid is being pumped into the wellbore behind the perforating gun.

FIG. 3E shows that the fracturing fluid of FIG. 3D is now being pumped through perforations formed in Zone B. Artificial fractures are being induced along Zone B. Simultaneously, ball sealers have been dropped into the wellbore above the fracturing fluid.

FIG. 3F shows fracturing fluid having been pumped through the perforations along Zone B. The ball sealers from FIG. 3E are placed along the perforations. Behind the ball sealers, and after removal of the wireline, a ball has been dropped onto a fracturing sleeve along Zone C, with new fracturing fluid being pumped behind the ball.

FIG. 3G shows the fracturing sleeve having been opened. Fracturing fluid is now being pumped through the sleeve to induce artificial fractures along Zone C. Simultaneously, ball sealers have been dropped into the wellbore behind the fracturing fluid.

FIG. 3H shows the ball sealers of FIG. 3G having landed on the fracturing sleeve to provide a seal. Additionally, a new fracturing gun is being lowered into the wellbore to form fractures along a zone above Zone C.

FIG. 5A is a first side view of the sliding sleeve. Here, the sliding sleeve is in position to receive a fracturing ball. A frac ball is seen being pumped down a housing towards a seat in the sliding sleeve.

FIG. 5B is a second side view of the sliding sleeve. Here, the frac ball has landed on the seat, creating a barrier to fluid flow through the bore.

FIG. 5C is a next side view of the sliding sleeve in operation. Here, hydraulic pressure has been applied against the ball and the seat. This has caused a first shear pin to shear, thereby allowing a tubular sleeve to move downward relative to a surrounding tubular housing. Ports in the tubular housing are now exposed.

FIG. 5D is a fourth side view of the sliding sleeve. Here, a fracturing fluid is being injected under pressure through the exposed ports and into a surrounding subsurface formation.

FIG. 5E is a next view of the sliding sleeve in operation. Here, a pair of ball sealers is being pumped downhole towards the ports.

FIG. 5F is a sixth side view of the sliding sleeve. Here, the ball sealers have landed securely in the ports, aided by hydrostatic and pumping pressure.

FIG. 5G is a next view of the sliding sleeve in operation. Here, a second shear pin residing along the tubular housing has been sheared in response to additional hydraulic pressure. This allows the tubular sleeve to slide further down the wellbore relative to the surrounding tubular housing. An elastomeric seal associated with the tubular sleeve is now covering the ball sealers.

FIG. 5H presents another side view of the sliding sleeve. Here, hydraulic pressure has forced ball seat dogs making up the seat to open, thereby releasing the frac ball from the sliding sleeve. Outer surfaces of the ball seat dogs now reside in a circumferential recess within the tubular housing.

In FIG. 6A, a heel of the wellbore and a toe of the wellbore are shown. Four separate sliding sleeves are shown having been placed along the wellbore, with others being present but not shown. The wellbore is ready for fracture stimulation treatment.

In FIG. 6B, a lower-most sleeve is opened. No ball need be dropped to open this lower-most sleeve. Fluids are injected through the sleeve, under pressure, in order to open up the subsurface formation at a lowest zone of interest.

In FIG. 6C, a first fracturing ball has been dropped. The ball is pumped down to a seat associated with a first sleeve in the series of sliding sleeves. This is in accordance with the step shown in FIGS. 5A and 5B, above.

In FIG. 6D, the first sleeve has been opened. Hydraulic fracturing fluids are being pumped through ports exposed in the first sliding sleeve. This is in accordance with the steps shown and described above in connection with FIGS. 5C and 5D.

In FIG. 6E, the fracturing ball has been forced off of the seat associated with the first sleeve. The ball is now being pumped down to the second sleeve in the series of sliding sleeves. This is in accordance with the steps shown and described above in connection with FIGS. 5G and 5H. In addition, ball sealers have been pumped down the wellbore and have landed in the ports of the first sleeve. This is in accordance with the steps shown and described above in connection with FIGS. 5E and 5F.

In FIG. 6F, the fracturing ball has landed on a seat associated with the second sleeve. Hydrostatic and pumping pressures have forced the second sleeve to open. Hydraulic fracturing fluids are being pumped through ports exposed in the second sliding sleeve.

In FIG. 6G, all zones along all sliding sleeves have been fractured. The fracturing ball has been forced off of each seat associated with the sleeves, and the ball has been pumped to the toe of the wellbore.

In FIG. 6H, a perforating gun is pumped downhole. The perforating gun is at the end of an electric wireline.

In FIG. 6I, the production casing is being perforated at the level of the final sliding sleeve.

In FIG. 6J, the perforating gun has been raised in the wellbore. The production casing is being perforated at the level of a higher sleeve.

In FIG. 6K, the production casing has been perforated at the level of all sliding sleeves. The wellbore is exposed to the surrounding subsurface formation along multiple zones.

DETAILED DESCRIPTION OF CERTAIN EMBODIMENTS

Definitions

Figure 1A:
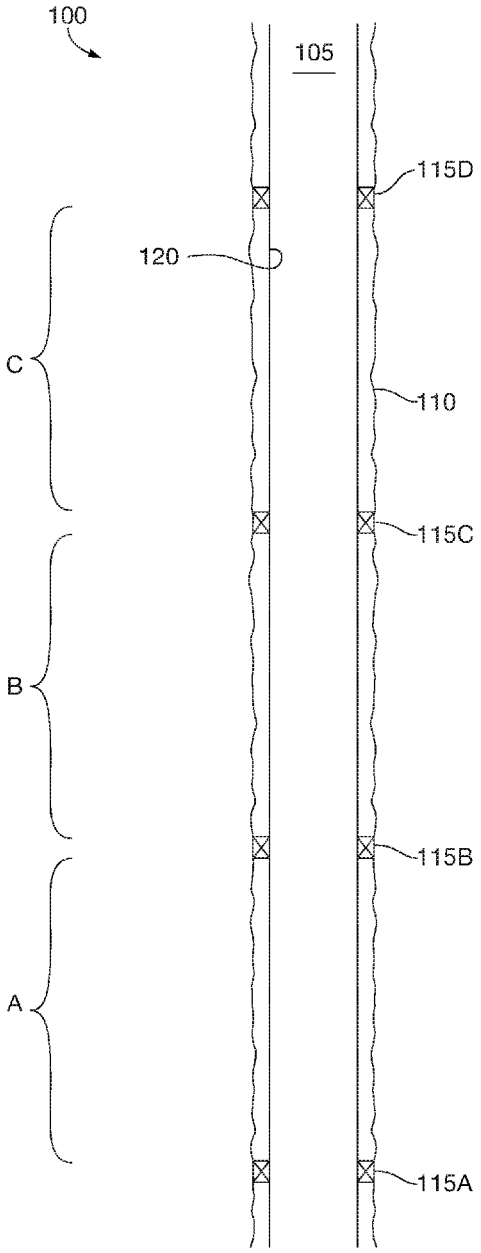
FIG. 1A Prior Art
FIGS. 1A through 1F present a series of side views of a lower portion of a wellbore. The wellbore is undergoing a completion procedure that uses perforating guns and ball sealers in stages. This is a known procedure.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. to 20° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refers to a portion of a formation containing hydrocarbons. Alternatively, the formation may be a water-bearing interval.

For purposes of the present patent, the term "production casing" includes a liner string or any other tubular body fixed in a wellbore along a zone of interest, which may or may not extend to the surface.

As used herein, the term "wellbore" refers to a hole in the subsurface made by drilling or insertion of a conduit into the subsurface. A wellbore may have a substantially circular cross section, or other cross-sectional shapes. As used herein, the term "well," when referring to an opening in the formation, may be used interchangeably with the term "wellbore."

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Wellbore completions in unconventional reservoirs are increasing in length. Whether such wellbores are vertical or horizontal, such wells require the placement of multiple perforation sets and multiple fractures. Known completions, in turn, require the addition of downhole hardware which increases the expense, complexity and risk of such completions.

Several techniques are known for fracturing multiple zones along an extended wellbore incident to hydrocarbon production operations. One such technique recently developed involves the use of ball sealers placed directly in casing perforations.

FIGS. 1A through 1F present a series of side views of a lower portion of an extended wellbore 100. The wellbore 100 is undergoing a completion procedure that uses perforating guns 150 and ball sealers 160, in stages. In the FIG. 1 series, the wellbore 100 is demonstrated as being completed in a vertical orientation; however, it is understood that wellbores completed in multiple stages are frequently completed horizontally.

First, FIG. 1A introduces the wellbore 100. The wellbore 100 is lined with a string of production casing 120. The production casing 120 defines a long series of pipe joints that are threadedly coupled, end-to-end. The production casing 120 provides a bore 105 for the transport of fluids into the wellbore 100 and out of the wellbore 100.

The production casing 120 resides within a surrounding subsurface formation 110. Annular packers are placed along the casing 120 to isolate selected subsurface zones. Three illustrative zones are shown in the FIG. 1 series, identified as "A," "B" and "C." The packers, in turn, are designated as 115A, 115B, 115C and 115D, and are generally placed intermediate the zones.

Figure 1B:
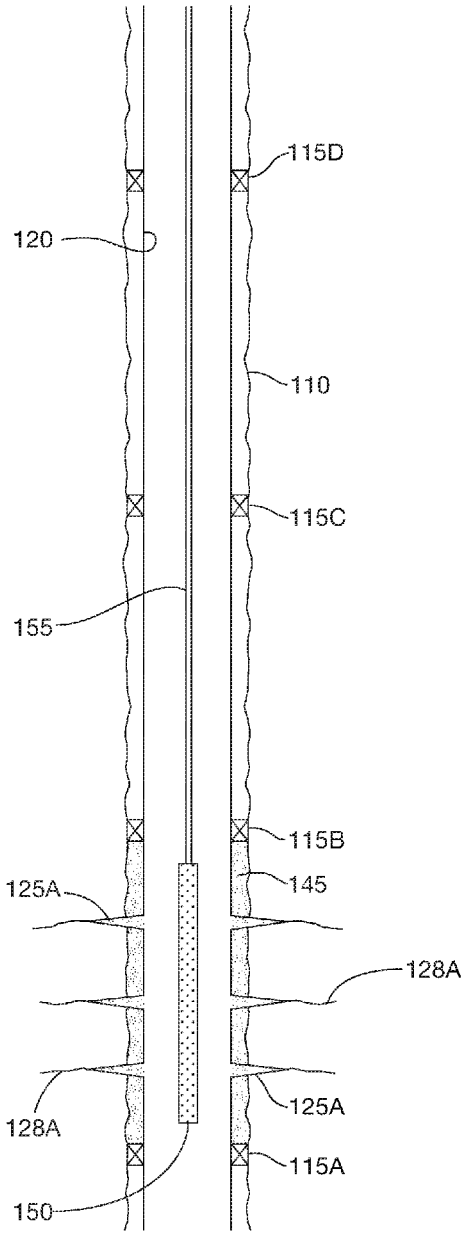
FIG. 1B Prior Art

It is desirable to perforate and fracture the formation along each of Zones A, B and C. FIG. 1B shows Zone A having been perforated. Perforations 125A are placed by detonating charges associated with a perforating gun 150. Further, fractures 128A have been formed in the subsurface formation 110 along Zone A. The fractures 128A are formed using any known hydraulic fracturing technique.

It is observed that in connection with the formation of the fractures 128A, a hydraulic fluid 145 having a proppant is used. The proppant is typically sand, and is used to keep the fractures 128A open after hydraulic pressure is released from the formation 110. It is also observed that after the injection of the hydraulic fluid 145, a thin annular gravel pack is left in the region formed between the casing 120 and the surrounding formation 110. This is seen between packers 115A and 115B. The gravel pack beneficially supports the surrounding formation 110 and helps keeps fines from invading the bore 105.

Figure 1C:
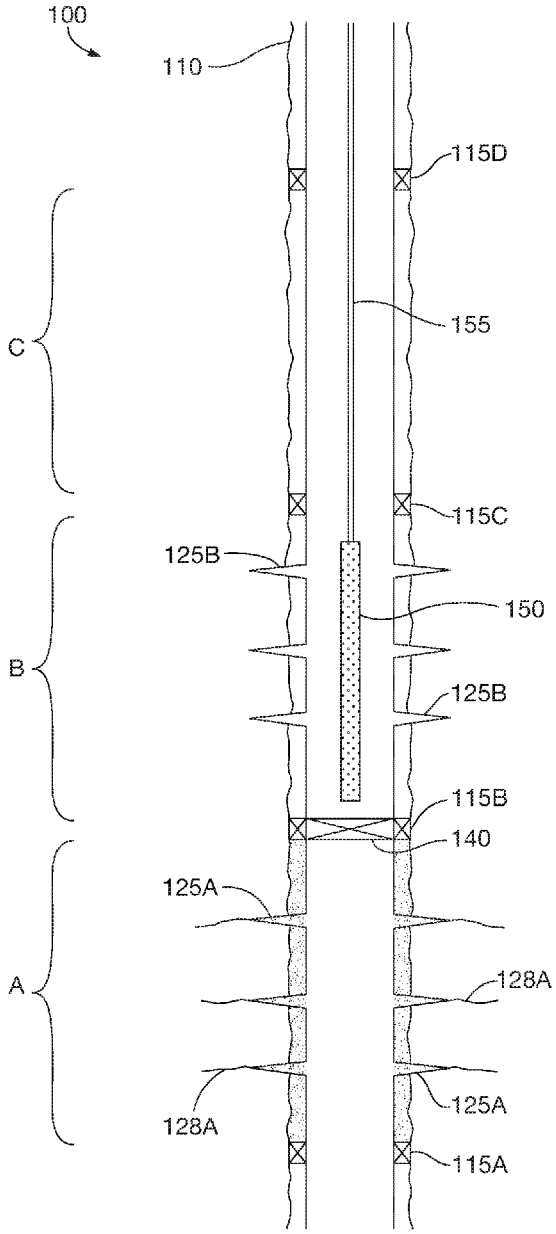
FIG. 1C Prior Art

As a next step, Zone B is fractured. This is shown in FIG. 1C. FIG. 1C shows that a plug 140 has been set adjacent the packer 115B intermediate Zones A and B. Further, the perforating gun 150 has been placed along Zone B. Additional charges associated with the perforating gun 150 are detonated, producing perforations 125B.

Figure 1D:
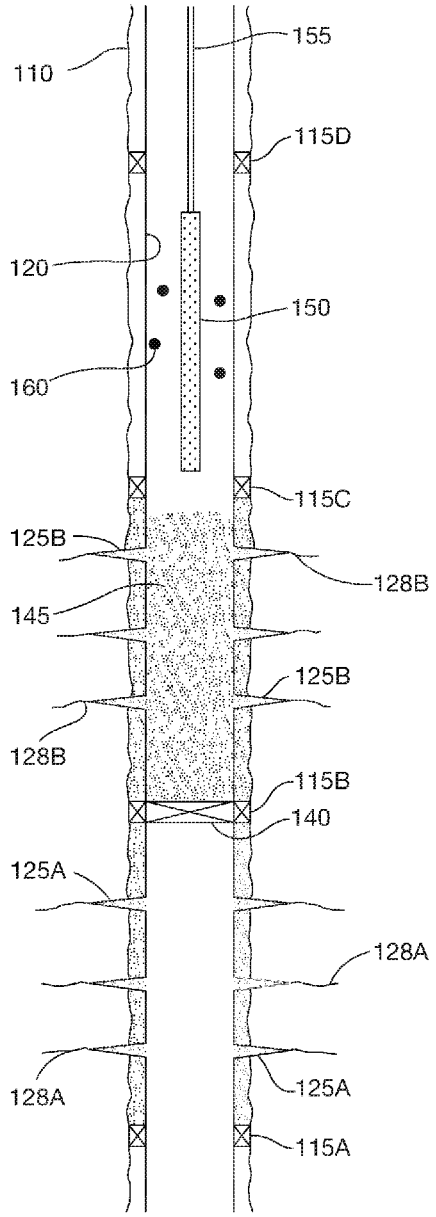
FIG. 1D Prior Art

Next, FIG. 1D shows that a fracturing fluid 145 is being pumped into the bore 105. Artificial fractures 128B are being formed in the subsurface formation 110 along Zone B. In addition, a new perforating gun 150 has been lowered into the wellbore 100 and placed along Zone C.

Figure 1E:
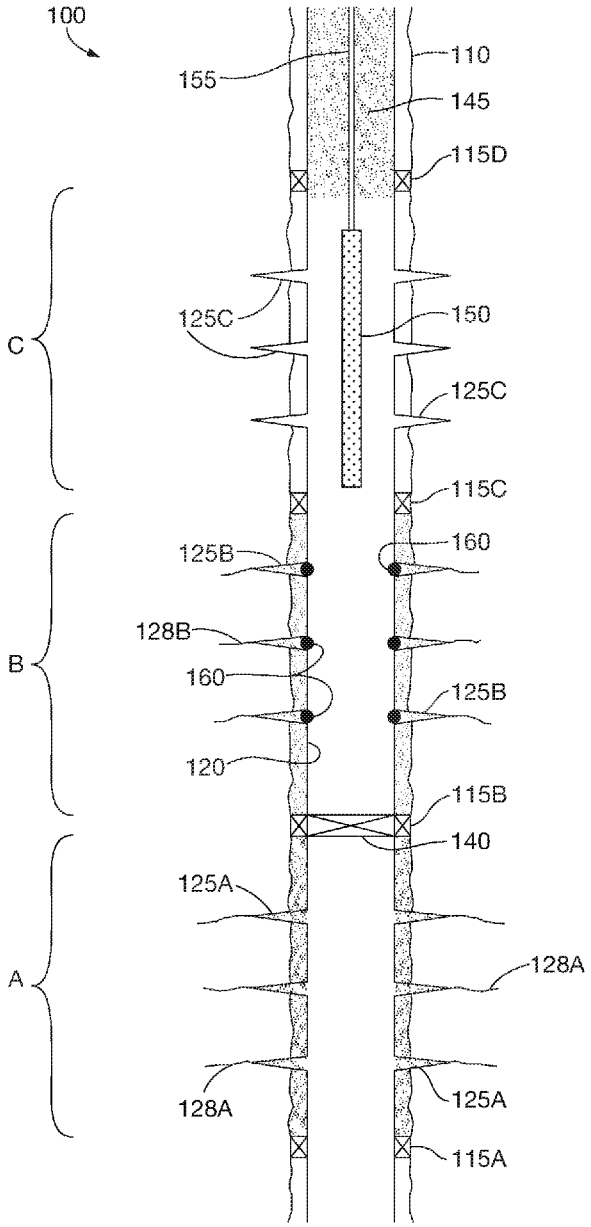
FIG. 1E Prior Art

FIG. 1E shows a next step in the completion of the multi-zone wellbore 100. In FIG. 1E, ball sealers 160 have been dropped into the wellbore and have landed along Zone B. The ball sealers 160 seal the perforations 125B along Zone B.

It is also observed in FIG. 1E that the perforating gun 150 has been raised in the wellbore 100 up to Zone C. Remaining charges associated with the perforating gun 150 are detonated, producing new perforations 125C. After perforating, a fracturing fluid 145 is pumped into the bore 105 behind the perforating gun 150, which in some embodiments may be suspended from a conveyance line or tubing 155.

Figure 1F:
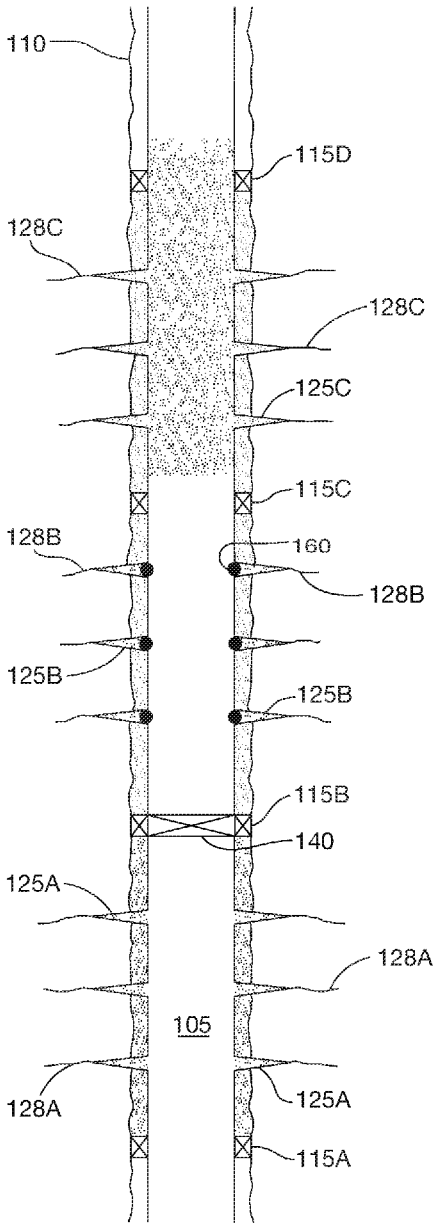
FIG. 1F Prior Art

Finally, FIG. 1F shows the fracturing fluid 145 being pumped further into the wellbore 100. Specifically, the fracturing fluid 145 is pumped through the new perforations 125C along Zone C. Artificial fractures 128C have been induced in the subsurface formation 120 along Zone C. The firing charges in the perforating gun 150 are now spent and the gun is pulled out of the wellbore 100.

The multi-zone completion procedure of FIGS. 1A through 1F is sometimes known as the "Just-In-Time" perforating process. The Just-In-Time perforating process represents an efficient method in that a fracturing fluid may be run into the wellbore with a perforating gun in the hole. As soon as the perfs are shot and fractures are formed, ball sealers are dropped. When the ball sealers seat on the perforations, a gun is shot at the next zone. These steps are repeated until all guns are spent. A new plug 140 is set and the process begins again.

The Just-In-Time perforating process requires low flush volumes and offers the ability to manage screen-outs along the zones. However, it does require that multiple plugs be drilled out in an extended horizontal well as a single perforating gun does not have enough charges to detonate at every zone. In addition, even this procedure is vulnerable to screen-out at the highest zone of a multi-zone stage. In this respect, if a screen-out occurs along Zone C during pumping, clean-out operations will need to be conducted. This is because the slurry 145 cannot be completely pumped through the perforations 125C and into the formation due to the presence of the ball sealers 160 along Zone B and the bridge plug 140 above Zone A. Furthermore, Just-In Time perforating is dependent upon pump pressure never being lost during a treatment sequence for stage isolation to be maintained. This is sometimes difficult to achieve in the field.

An alternate completion procedure that has been used involves the placement of multiple fracturing sleeves (or "frac sleeves") along the production casing. This is known as "Ball and Sleeve" completion. The Ball and Sleeve technique is illustrated in FIGS. 2A through 2F. The FIG. 2 series of drawings presents a series of side views of a lower portion of a wellbore 200. The wellbore 200 is undergoing a completion procedure that uses frac sleeves 221 in stages. The frac sleeves 221A, 221B, 221C are sequentially opened using balls 223A, 223B, 223C.

Figure 2A:
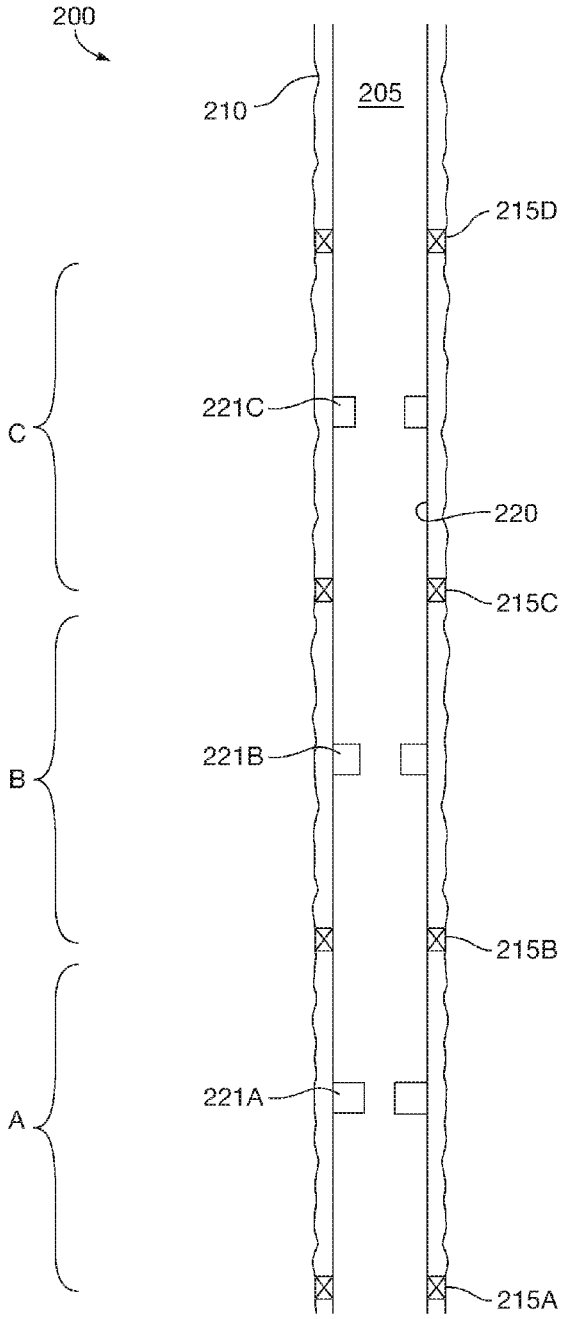
FIG. 2A Prior Art
FIGS. 2A through 2F present a series of side views of a lower portion of a wellbore. The wellbore is undergoing a completion procedure that uses fracturing sleeves and dropped balls, in stages. This is a known procedure.

First, FIG. 2A introduces the wellbore 200. The wellbore 200 is identical to the wellbore 100 of FIG. 1A. The wellbore 200 is lined with a string of production casing 220 that provides a bore 205 for the transport of fluids into and out of the wellbore 200. Annular packers 215A, 215B, 215C, 215D are placed along the casing 220 to isolate selected subsurface zones. The zones are identified as "A," "B" and "C."

Figure 2B:
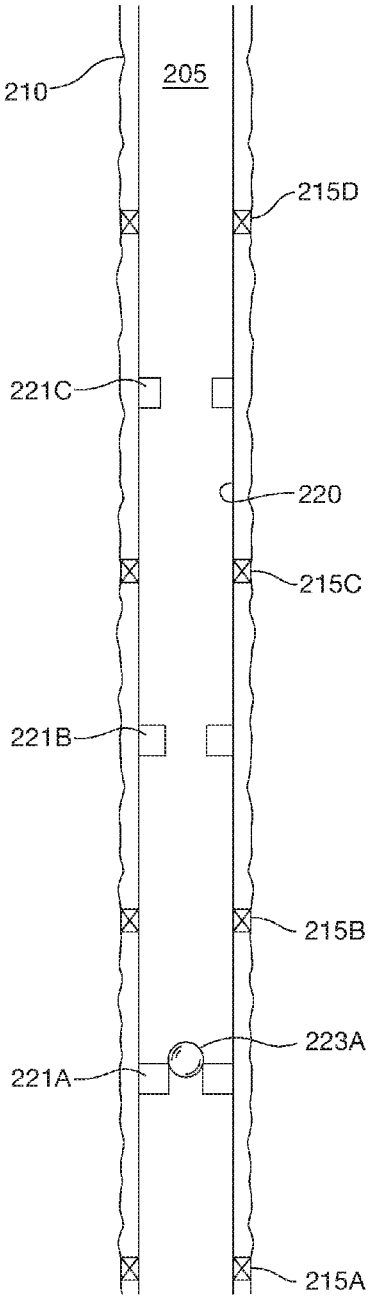
FIG. 2B Prior Art

Looking now at FIG. 2B, it can be seen that frac sleeve 221A has been placed along Zone A. The frac sleeve 221A comprises a seat dimensioned to receive a small-diameter ball. In FIG. 2B, a fracturing ball 223A has been dropped into the wellbore 200 and has landed onto the frac sleeve 221A.

Figure 2C:
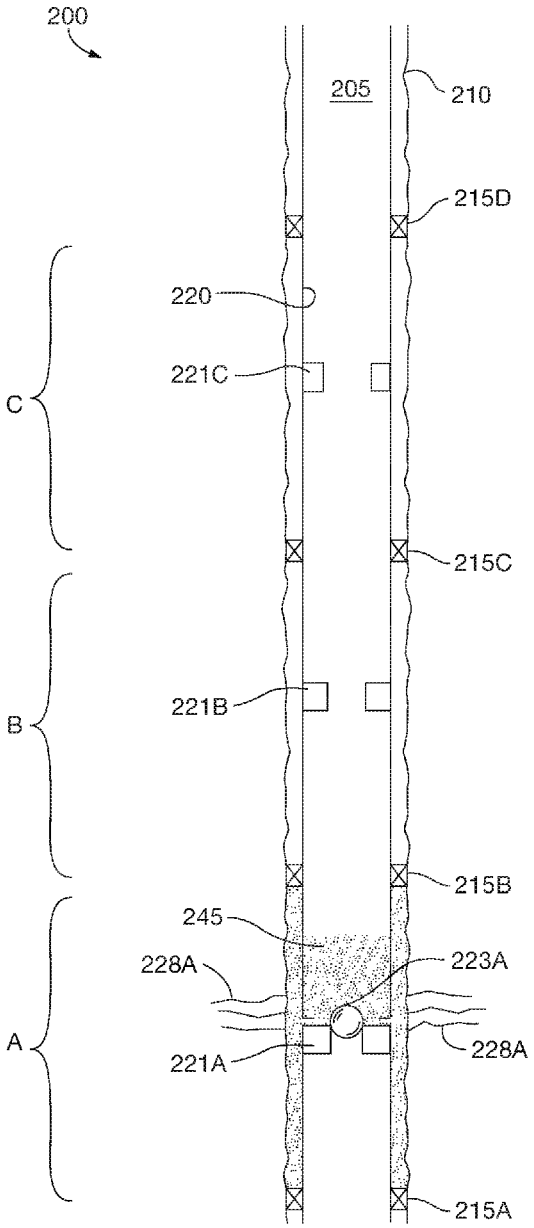
FIG. 2C Prior Art
Figure 2D:
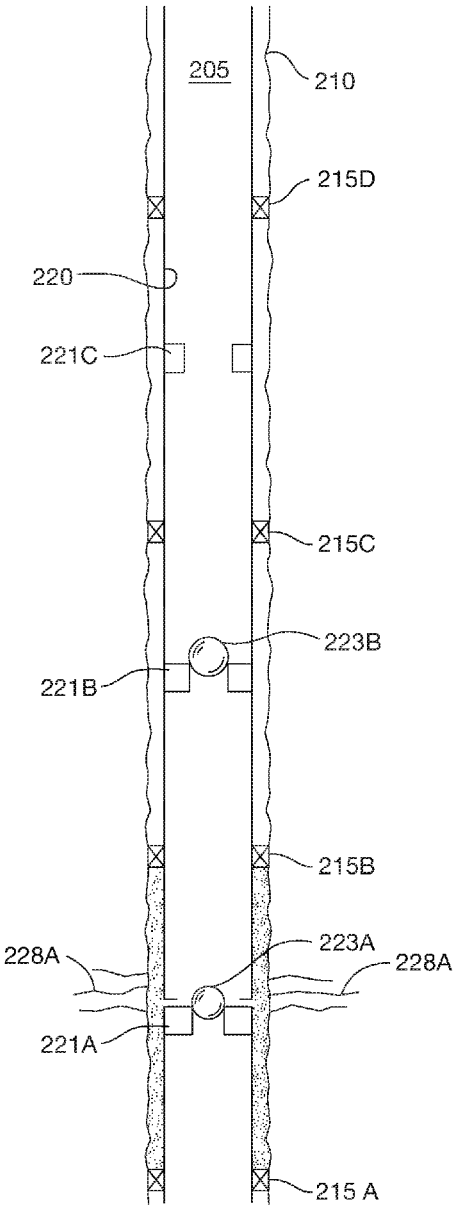
FIG. 2D Prior Art

FIG. 2C shows that hydraulic pressure has been applied to open the fracturing sleeve 221A. This is done by pumping a fracturing fluid 245 into the bore 205. As shown in FIG. 2C, the fracturing fluid 245 flows through an exposed port in the frac sleeve 221A, into the annular region between the production casing 220 and the surrounding subsurface formation 210, and into the formation 210 itself. Fractures 228A are being induced in the subsurface formation 210 along Zone A. Additionally, proppant is seen now residing in the annular region along Zone A.

In the completion method of the FIG. 2 drawings, the process of opening a sleeve and fracturing along Zone A is repeated in connection with Zones B and C. FIG. 2D shows that a second ball 223B has been dropped into the wellbore 200 and landed on a sleeve 221B, hydraulically isolating flow into the wellbore zone 225A below ball 223B and above ball 223A. The sleeve 221B resides along Zone B.

Figure 2E:
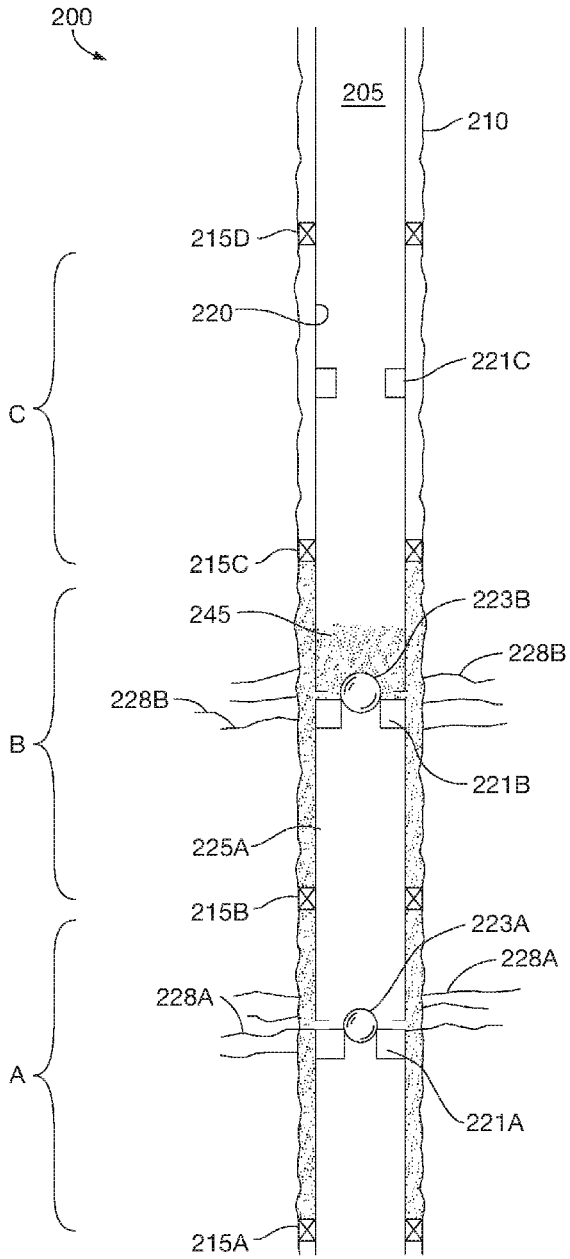
FIG. 2E Prior Art

FIG. 2E shows that hydraulic pressure has been applied to open the fracturing sleeve 221B, thereby exposing new ports. This is done by pumping a fracturing fluid 245 into the wellbore 200. Fracturing fluid is injected through the ports and into the formation 210. Fractures are being induced in the subsurface formation 210 along Zone B. Also, proppant is seen residing now in an annular region along Zone B.

Figure 2F:
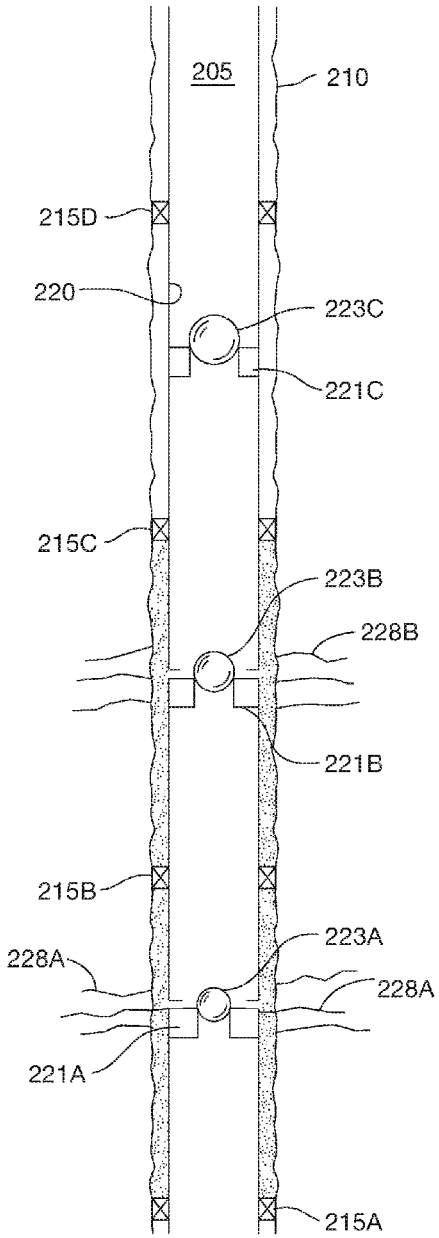
FIG. 2F Prior Art

The "Ball and Sleeve" process is repeated for Zone C. FIG. 2F shows that a third frac ball 223C has been dropped into the bore 205. The ball 223C has landed onto the frac sleeve 221C adjacent Zone C. It is understood that fractures (not shown) are then created in the subsurface formation 210 along Zone C.

The use of the sleeves 221A, 221B, 221C as shown in the FIG. 2 series reduces the flush volumes needed for completion. This, in turn, reduces the environmental impact. At the same time, in order to fracture multiple zones, the "Ball and Sleeve" process requires the use of many separate sleeves. Those of ordinary skill in the art will understand that each successive sleeve moving down the wellbore has a smaller inner diameter for the ball seat. This limits the number of sleeves that can be used in a lateral completion. Additionally, while balls can be flowed back, the uncertainty of flowback often compels users to drill out both frac balls and ball seats integral to the sleeves. This drill out incurs additional financial and time cost for wellbore completion. Further, the use of multiple sleeves creates a higher hardware risk and a higher risk of screen-out, and requires the operator to drop balls in the proper order, that is, in ascending diameter.

As the need for "pinpoint stimulation" has gained recognition, the number of stages may increase in the future for a given well length. In addition to the compounding complication of extended-length multi-zone completions, drill out or clean out of the hardware is required after completion. This is because the ever-decreasing sleeve size to the end of the wellbore will not accommodate most logging tools or entry of a 2⅜" EUE upset tubing working string for cleanout or other activities. Thus, sleeves and seats and other devices must be milled/drilled out. In addition, much of the applied technology reduces the working ID of casing, limiting intervention with coiled or jointed tubing strings.

FIGS. 3A through 3F present a series of side views of a lower portion of a wellbore 300. The wellbore 300 is undergoing a completion procedure that that uses a series of perforating guns 350 and ball sealers 360 in a process that attempts to reduce the number of sleeves and attendant hardware.

Figure 3A:
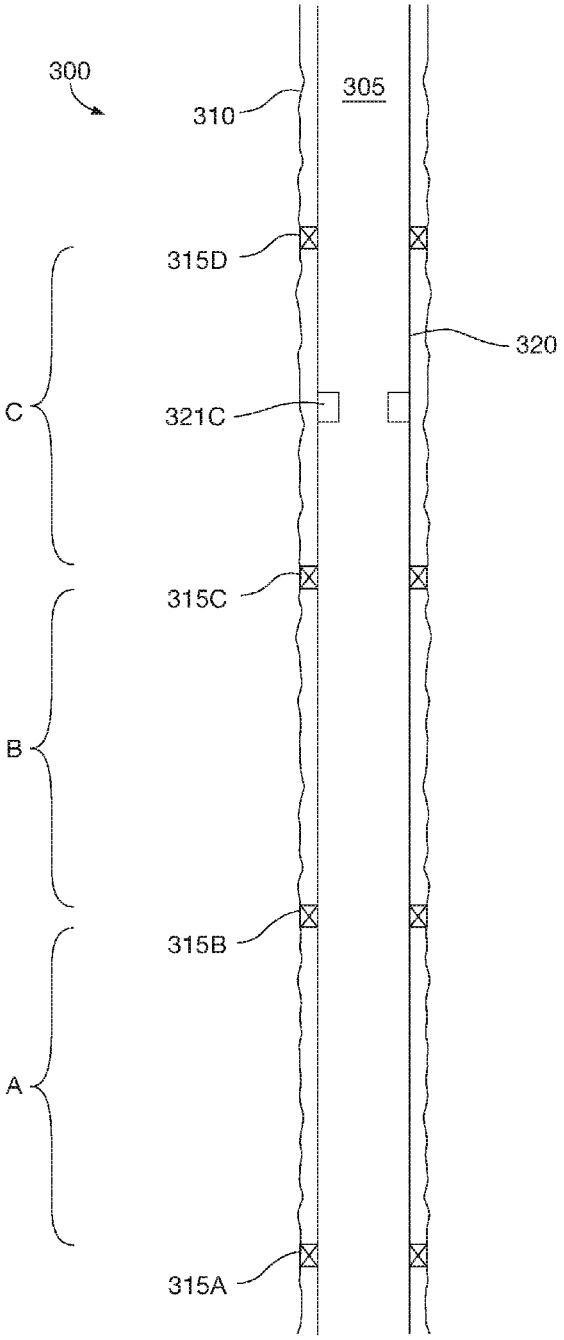
FIGS. 3A through 3H present a series of side views of a lower portion of a wellbore. The wellbore is undergoing a completion procedure that uses perforating guns and ball sealers without sleeves to create the reservoir/production casing interface.

First, FIG. 3A introduces the wellbore 300. The wellbore 300 is again identical to the wellbore 100 of FIG. 1A. The wellbore 300 is lined with a string of production casing 320. The production casing 320 provides a bore 305 for the transport of fluids into and out of the wellbore 300.

The production casing 320 resides within a surrounding subsurface formation 310. Annular packers 315A, 315B, 315C, 315D are again placed along the casing 320 to isolate selected subsurface zones, identified as "A," "B" and "C." The packers, in turn, are designated as 315A, 315B, 315C and 315D.

Figure 3B:
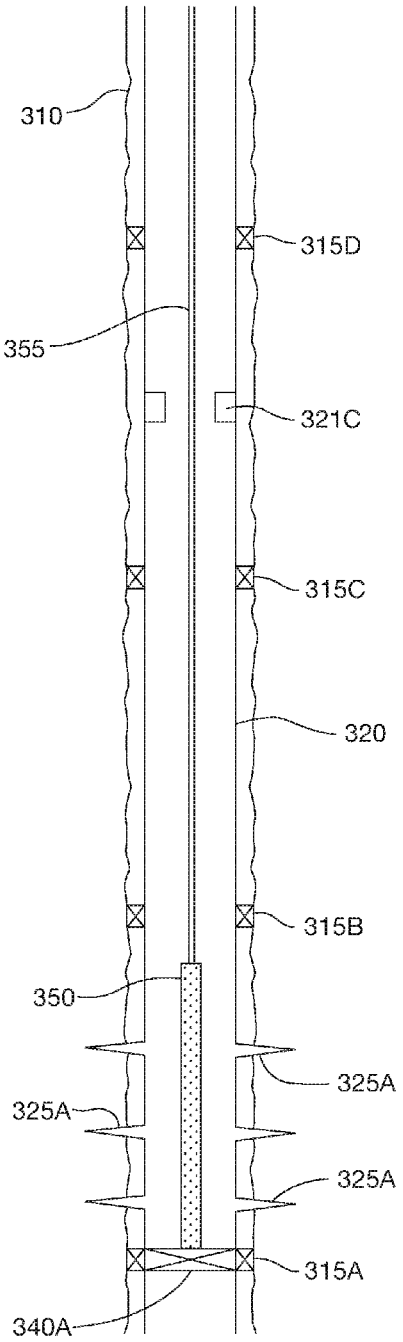

In order to complete the wellbore 300, Zones A, B and C are each perforated. In FIG. 3B, a perforating gun 350 has been run into the bore 305. The gun 350 has been placed along Zone A. Perforations 325A have been formed in the production casing 320 by detonating charges associated with the perforating gun 350.

The perforating gun 350 may be a select fire gun that fires, for example, 16 shots. The gun 350 has associated charges that detonate in order to cause shots to be fired from the gun 350 into the surrounding production casing 320. Typically, the perforating gun 350 contains a string of shaped charges distributed along the length of the gun 350 and oriented according to desired specifications. However, in the gun 350, the charges are not connected to a single detonating cord; instead, a series of cords, such as four cords, is provided to allow sequential signals and to ensure that simultaneous detonation of all charges does not take place. Examples of suitable perforating guns include the Frac Gun™ from Schlumberger, and the G-Force® from Halliburton.

Along with the perforating gun 350, a plug 340A has been set. In practice, the plug 340A is typically run into the bore 305 at the lower end of the perforating gun 350 on a wireline 355. In other words, the plug 340A and the gun 350 are run into the wellbore 300 together before the charges are detonated.

Next, a fracturing fluid 345 is injected into the newly-formed perforations 325A. The fracturing fluid 345, with proppant, is injected under pressure in order to flow through the perforations 325A and into the formation 310. In this way, artificial fractures 328A are formed.

Figure 3C:
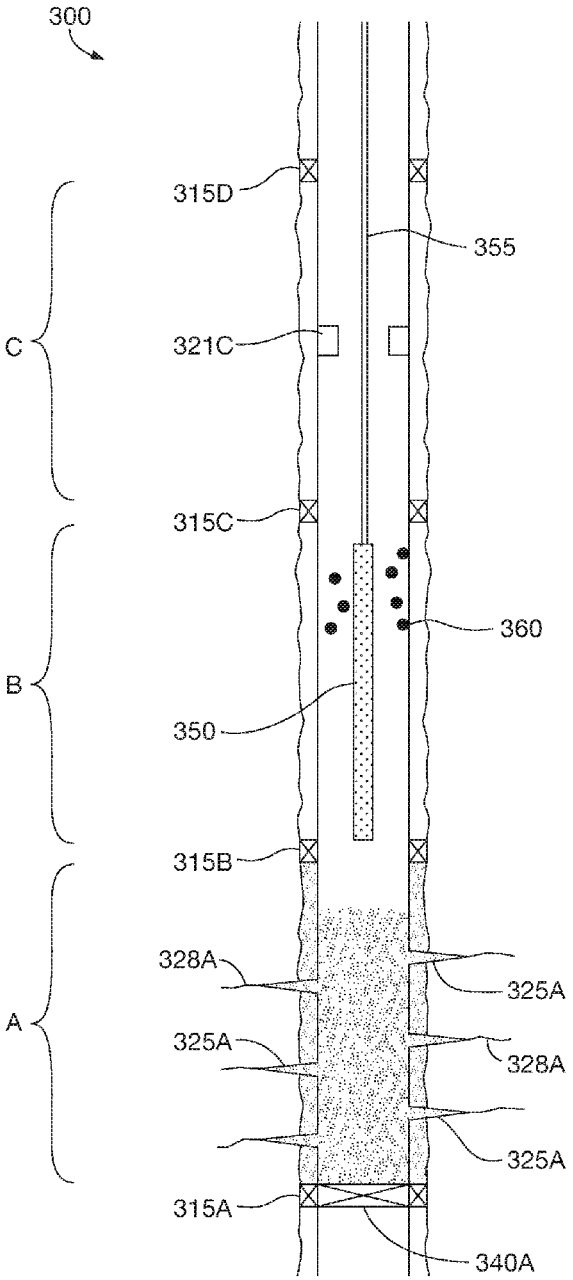
Figure 3D:
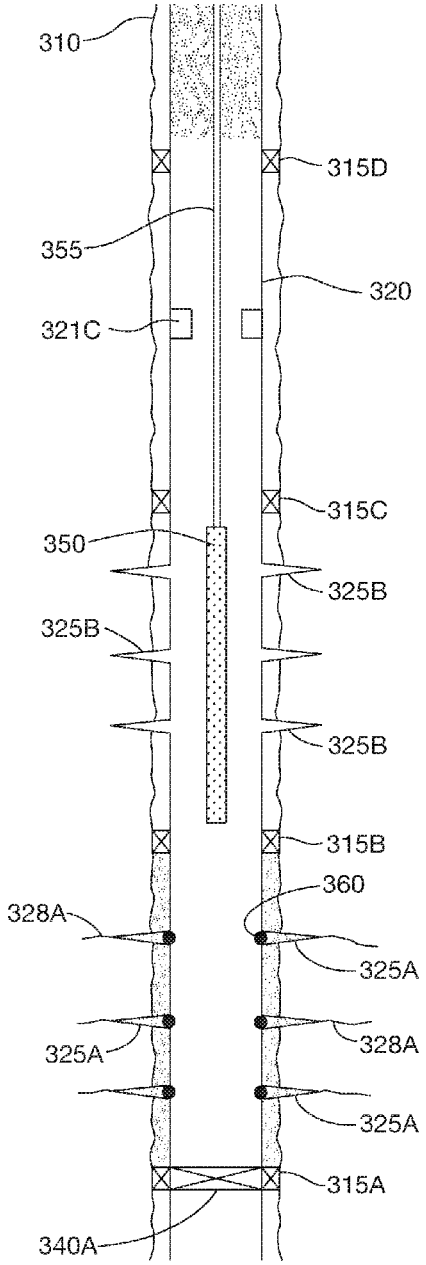

FIG. 3C shows that fractures 328A have been formed in the subsurface formation 310 along Zone A. Proppant is now seen residing in an annular region along Zone A. Thus, something of a gravel pack is formed as fracturing fluid 345 is injected.

Of interest, the multi-zone fracturing of the FIG. 3 series of drawings is seamless. This means that preparations for fracturing a next zone are already under way while a present zone is being fractured. In the view of FIG. 3C, the perforating gun 350 has been raised up to Zone B. Additionally, ball sealers 360 have been dropped into the bore 305.

In the completion method of the FIG. 3 drawings, the process of perforating and fracturing along Zone A is repeated in connection with Zones B and C. FIG. 3D shows that charges associated with the perforating gun 350 have been detonated, forming perforations 325B along Zone B. At the same time, the ball sealers 360 have plugged the perforations 325A along Zone A. For this reason, there is beneficially no need for setting a new plug adjacent packer 315B.

Figure 3E:
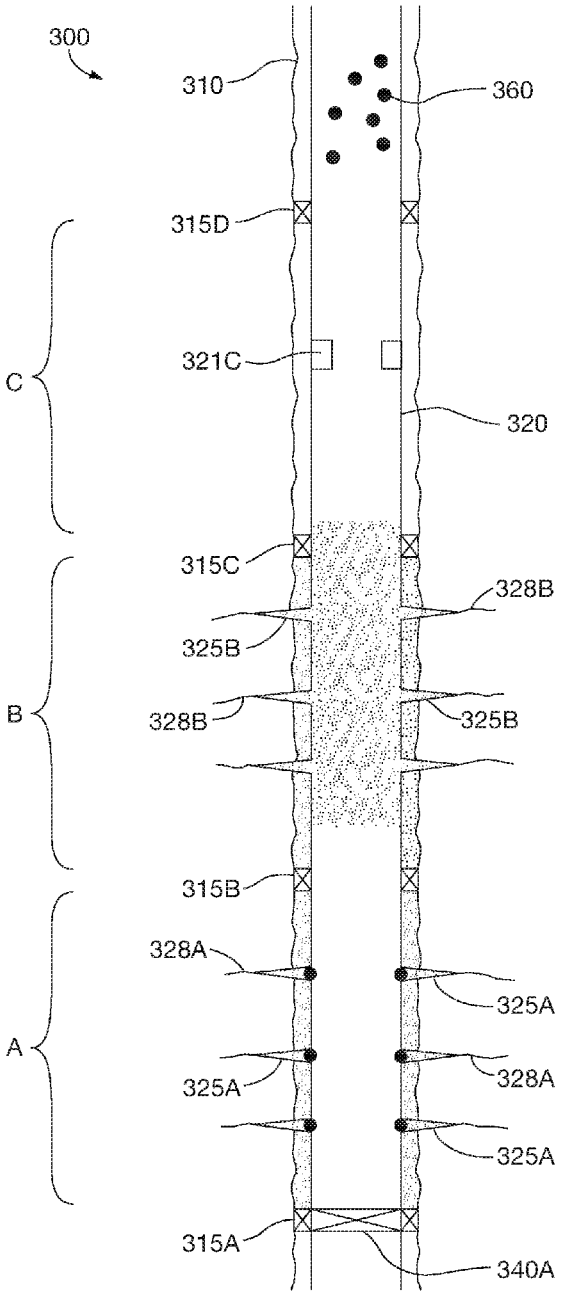

Next, fracturing fluid 345 is injected into the newly-formed perforations 325B. The fracturing fluid 345, with proppant, is injected under pressure in order to flow through the perforations 325B and into the formation 310. In this way, and as shown in FIG. 3E, new artificial fractures 328A are formed. At the same time, a new set of ball sealers 360 has been released into the bore 305.

It is noted that at some point the charges in the perforating gun 350 will be spent. In one embodiment of the method of the FIG. 3 series, charges are shot until the gun 350 reaches a frac sleeve along the casing 320. In FIG. 3E, an illustrative frac sleeve 321C is shown along Zone C. The frac sleeve 321C is in its closed position.

Figure 3F:
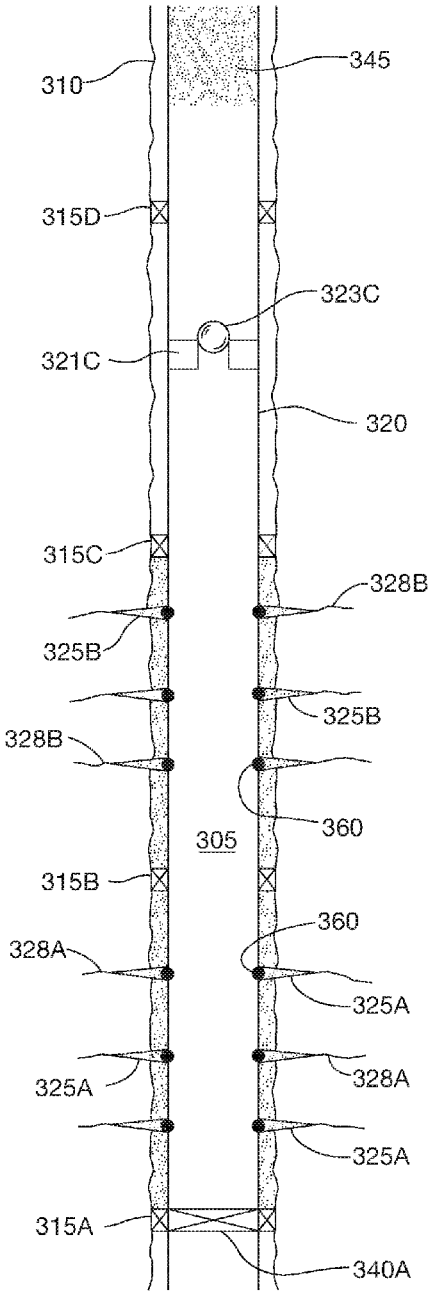

FIG. 3F shows that ball sealers 360 have been placed in the perforations 325B along Zone B. In addition, a fracturing ball 323C has been dropped into the bore 305 and landed on the frac sleeve 321C. Further, fracturing fluid 345 is being pumped through the perforations along Zone C. The fracturing fluid 345 is pumped into the wellbore 300 behind the ball 323C, which in turn is dropped behind the ball sealers 360. In this way, no stoppage of operations occurs.

It is observed that in a horizontal well, the last sleeve would need to stay open to allow for pump down of the ball 323C; otherwise, the well would have no injectivity as all perforations would be covered with ball sealers 360. Alternatively, pumping of the ball sealers 360 covering fractures 325B would have to be omitted. It is also noted that in order to drop or pump the ball 323C down the wellbore 300, the wireline 355 and perforating gun 350 must be removed from the bore 305.

Figure 3G:
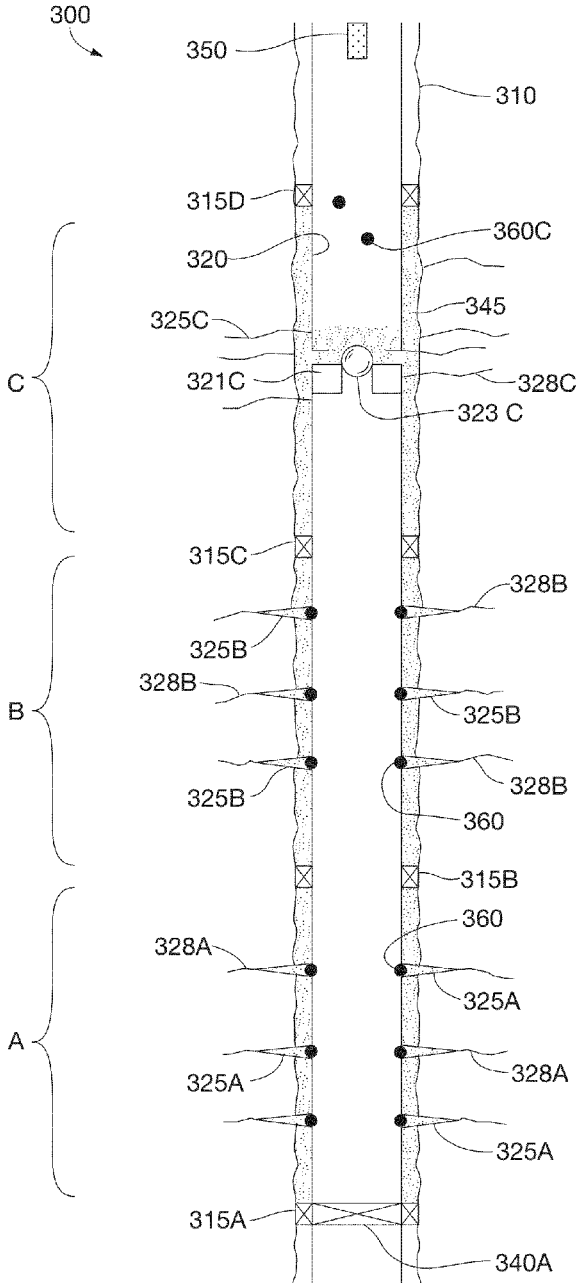

As a next step in the operation, the frac sleeve 321C is opened. FIG. 3G shows the fracturing sleeve 321C having been opened. This is done by pumping a fracturing fluid 345 into the wellbore 300 under pressure. As the sleeve 321C opens, fracturing fluid 345 flows through the sleeve 321C, into the annular region between the production casing 320 and the surrounding subsurface formation 310, and into the formation 310 itself. Fractures 328C are being induced in the subsurface formation 310 along Zone C. Additionally, proppant is seen now residing in the annular region along Zone C.

In accordance with the seamless nature of the operation, ball sealers 360C have been dropped in the wellbore 300 behind the fracturing fluid 345. These ball sealers 360C are dimensioned to plug the frac sleeve 321C after fractures 328C have been formed along Zone C.

Figure 3H:
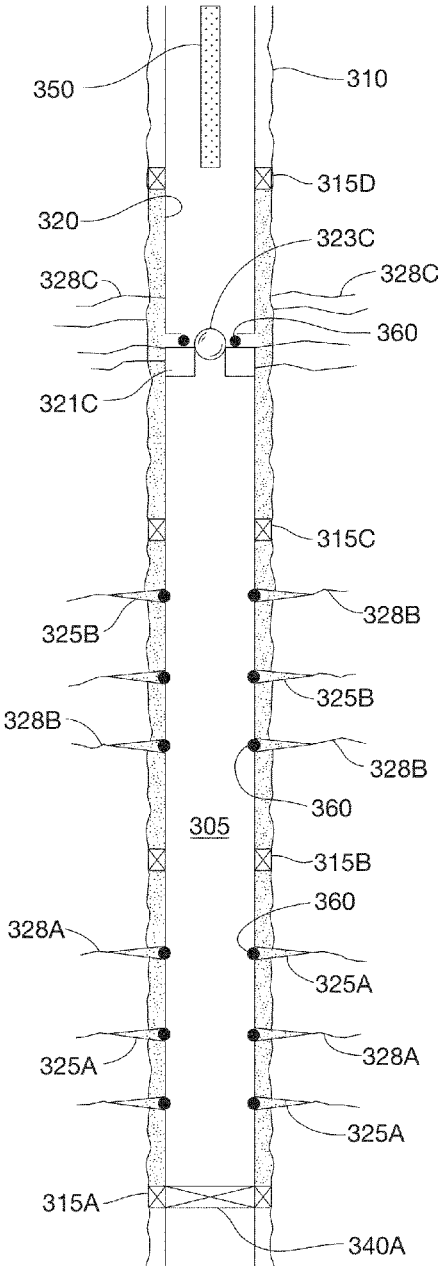

Moving to the next drawing, FIG. 3H shows the ball sealers 360C of FIG. 3G having landed on the fracturing sleeve 321C. This seals the fracturing sleeve 321C from future fluid injections. Additionally, a new fracturing gun 350 is being lowered into the wellbore 300 on a wireline (not shown) to form fractures along a zone above Zone C. Thus, multiple additional zones may be perforated and fractured using the same gun 350 until those charges are spent and a next frac sleeve is encountered.

The multi-zone fracturing process of the FIG. 3 series represents a modification of the Just-In-Time perforating process. This process allows multiple zones along a wellbore to be perforated while using a fewer number of frac sleeves. However, a series of progressively smaller frac sleeves is still required. Further, the frac balls have to be flowed back or drilled out. Empirically, flowback is not a reliable process and drillout is often favored.

It is also observed that this improved Just-In-Time perforating process requires careful execution. If the operator fails to maintain proper pressure in the wellbore at all times, ball sealers may drop out of some of the perforations. This inhibits the effectiveness of fracturing operations further up-hole.

To overcome the problems associated with the use of frac sleeves, frac balls and ball sealers shown above in the FIG. 1, the FIG. 2 and the FIG. 3 series of drawings, a novel fracturing sleeve is proposed herein. The fracturing sleeve is designed to be placed along a string of production casing (or liner), with multiple fracturing sleeves fabricated from the same dimensions being placed in series along selected zones of interest.

Figure 4:
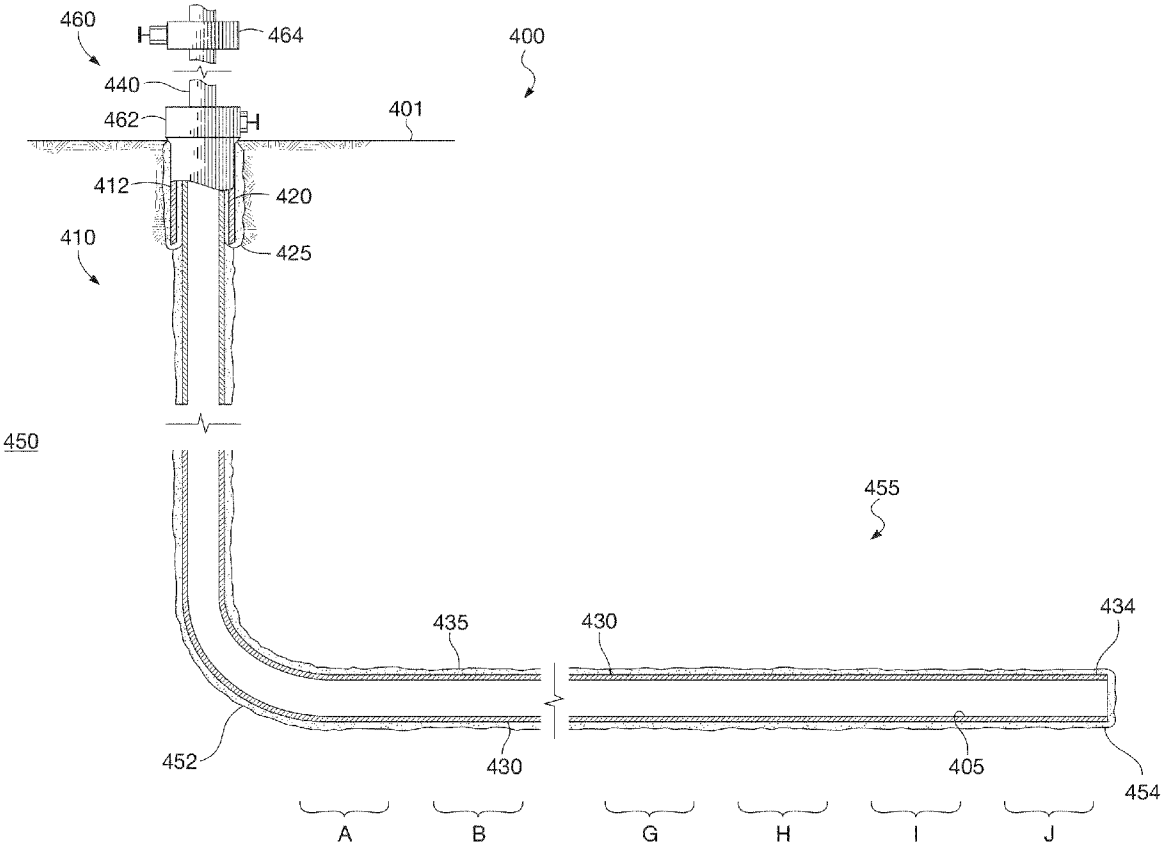
FIG. 4 is a cross-sectional side view of a well. The illustrative well is being completed in a subsurface formation in a generally horizontal orientation. Multiple zones are identified along the horizontal portion.

FIG. 4 is a cross-sectional side view of a well 400. The well 400 is being completed in a subsurface formation 450. Additionally, the illustrative well 400 is being completed in a horizontal orientation, having a horizontal portion 455, with the horizontal portion 455 having a heel 452 and a toe 454.

Along the horizontal portion 455, the well 400 has been divided into multiple zones. These are shown by brackets labeled "A," "B," "G," "H," "I" and "J." The horizontal portion 455 is of indeterminate length, being broken up for illustrative purposes. The broken portion may include, for example, zones "C," "D," "E" and "F" (not shown), and even other zones.

Zone "A" is located proximate the heel 452 while zone "J" is located proximate the toe 454. It is desirable to fracture each of the zones (zones "A" through "J") separately. This is done by isolating the zones, and then injecting a fracturing fluid into the subsurface formation 450 adjacent each zone (zones "A" through "J") sequentially.

The fracturing fluid must be injected under significant pressure to produce the desired fractures. To do this, the well 400 includes a well head 460. The well head 460 is positioned at an earth surface 401 to control and direct the flow of injection fluids from the surface 401 and into the subsurface formation 450. The well head 460 may be any arrangement of pipes or valves configured for the injection of fluids. The illustrative well head 460 includes a top valve 464 and a bottom valve 462. In some contexts, these valves are referred to as "master fracture valves." Of course, other valves may also be provided.

A wellbore 410 is completed below the wellhead 460 using a series of pipe strings referred to as casing. First, a string of surface casing 420 has been cemented into the formation 450. Cement is shown in an annular bore 425 of the wellbore 410. The combination of the casing 420 and the cement sheath in the annular area 425 strengthens the wellbore 410 and facilitates the isolation of zones behind the casing 420. The surface casing 420 has an upper end 412 in sealed connection with the lower master valve 462.

At least one intermediate string of casing (not shown) is typically cemented into the wellbore 410. It is understood that a wellbore may, and typically will, include more than one string of intermediate casing. Some of the intermediate casing strings may be only partially cemented into place, depending on regulatory requirements and the presence of migratory fluids in any adjacent strata. Either an intermediate string of casing or a final production casing 430 is positioned and cemented into a wellbore 435 and includes a through bore 405 that may be in sealed fluid communication with the upper master valve 464. The production casing 430 may optionally be a liner string which is hung from an intermediate casing string using a liner hanger (not shown).

A portion of the production casing 430, or liner, may optionally be cemented in place. The production liner 430 has a lower end 434 that extends to an end 454 of the wellbore 410. In accordance with the inventions herein, a series of novel sliding sleeves is placed along the production casing 430, such as along each of zones "A" through "J".

FIGS. 5A through 5H present side, cross-sectional views of a sliding sleeve 500 of the present invention, in one embodiment, suitable for use in the wellbore 410. The sliding sleeve 500 generally includes a tubular housing 510 having a first end 512 and a second end 514. The sliding sleeve 500 also has a tubular sleeve 520 residing concentrically therein. The tubular sleeve 520 also includes a first end 522, and then a second end 524 that defines radial collet fingers.

A bore 505 is formed within the housing 510 and the tubular sleeve 520. The bore 505 includes a recess 515 proximate the second end 514. The recess 515 represents an area of enlarged inner diameter along the housing 510.

The sliding sleeve 500 has threaded connections at the opposing ends 512, 514 of the housing 510. The first end 512 comprises a box end 512', while the second end 514 comprises a pin end 514'. In this way the sleeve 500 may be threadedly connected in series with the production casing (such as casing 430 of FIG. 4). Multiple sleeves 500 will be spaced along the casing 430 (or liner) to enable multi-stage fracturing and/or acid stimulation.

Figure 5A:
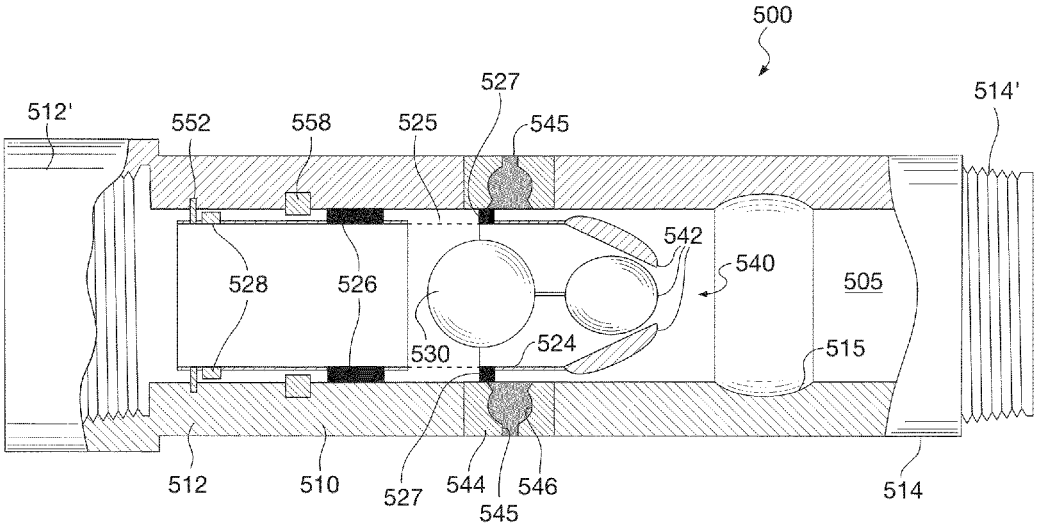
FIGS. 5A through 5H present side, cross-sectional views of a sliding sleeve of the present invention, in one embodiment. The sliding sleeve overcomes certain technical issues that may be encountered in connection with the completion procedures of the FIG. 1, FIG. 2 and FIG. 3 series of drawings.

FIG. 5A is a first side view of the sliding sleeve 500. Here, the sliding sleeve 500 is in position to receive a fracturing ball 530. The fracturing ball (or "frac" ball) is dropped by the operator from the surface (such as surface 401 of FIG. 4). A frac ball 530 is seen being pumped down the bore 505 towards a seat 540 in the sliding sleeve 500. The pump-down fluid may be an aqueous fluid, such as shown at 560 in FIG. 5D.

The seat 540 is not a conventional ring as used in known fracturing sleeves; rather, the seat 540 defines a series of radially-disposed dogs 542 residing at a lower end 524 of the tubular sleeve 520. The dogs 542 may be cup-shaped, and are biased somewhat inwardly to fill the bore 505. Preferably, some degree of overlap exists among the dogs 542. The dogs 542 extend from individual collet fingers which make up the lower end 524.

It is observed from FIG. 5A that the sleeve 500 also includes one or more ports 545. The ports 545 represent through-openings along the housing 510. The ports 545 preferably include abrasion-resistant inserts 544. The ports 545 are also sized to define a seat 546 which receives a ball sealer. Ball sealers are shown at 535 and are described below in connection with FIGS. 5E and 5F.

In the state of FIG. 5A, the ports 545 are generally closed off to fluid flow from the bore 505. More particularly, the lower end 524 of the tubular sleeve 520 and elastomeric seals 527 covers the ports 545. However, the tubular sleeve 520 is designed to slide downward in response to hydraulic pressure, thereby aligning openings 525 in the sleeve 520 with the ports 545.

Figure 5B:
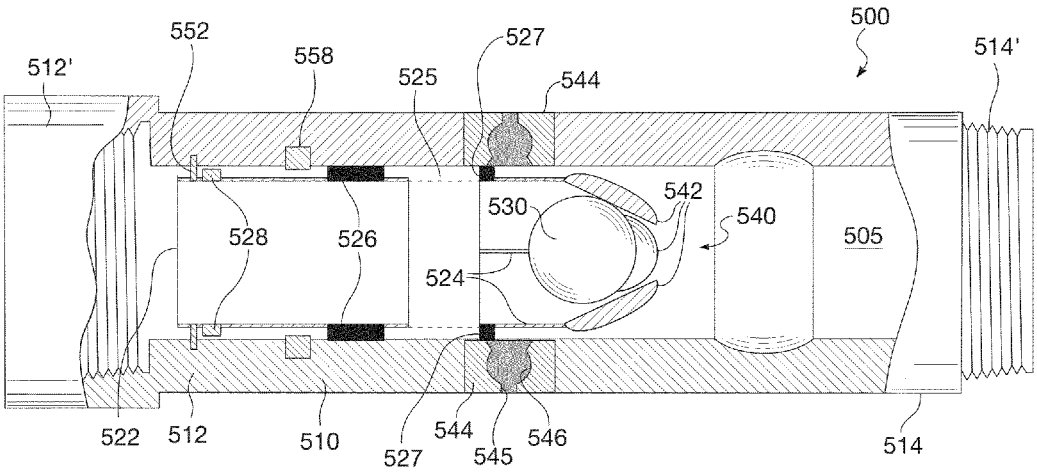

FIG. 5B is a second side view of the sliding sleeve 500. Here, the frac ball 530 has moved down the bore 505 and has landed on the seat 540. The biasing force residing at the lower end 524 of the sleeve 520 and in the dogs 542 holds the frac ball 530 within the sliding sleeve 500, creating a pressure seal. At the same time, the tubular sleeve 520 is held in place by a first shear pin 552, which connects the sleeve 520 to the housing 510 at the first end 522 of the sleeve 520. In the arrangement of the FIG. 5 series of drawings, the first shear pin 552 extends into the housing 510 at a first end 512 of the housing 510.

It is observed that the first shear pin 552 is preferably engineered to shear at a pressure lower than an anticipated formation fracturing pressure. For example, the shearing rate of the first shear pin 552 may be 500 psi lower than the formation parting pressure. The shearing rate is certainly engineered at a pressure that is well below the burst rating for the casing 630, such as illustrated in FIGS. 6A-6J.

Figure 5C:
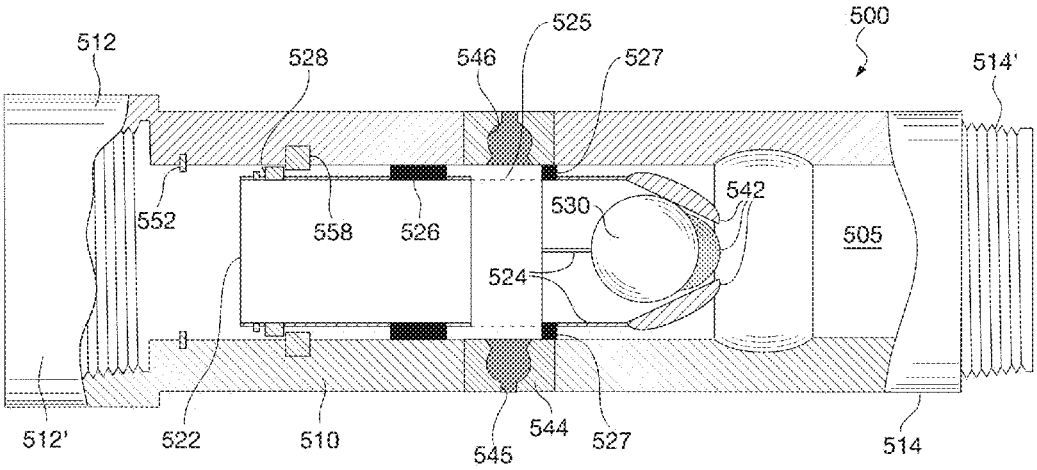

FIG. 5C is a next side view of the sliding sleeve 500 in operation. Here, hydraulic pressure has been applied against the ball 530 and the seat 540. This has caused the first shear pin 552 to shear. This is considered to be a first degree of hydraulic pressure. As can be seen, shearing the first shear pin 552 releases the tubular sleeve 520 from the housing 510. This, in turn, allows the tubular sleeve 520 to move downward in the bore 505 relative to the tubular housing 510. The through-openings 525 in the sleeve 520 are now aligned with the ports 545 in the tubular housing, thereby exposing the ports 545.

The tubular sleeve 520 includes a pair of elastomeric seals 526 and shoulder 528 along an outer diameter. As the tubular sleeve 520 slides down the housing 510, the seals 526, 527 straddle the ports 545. A shoulder 528 also residing along an outer diameter of the tubular sleeve 520 will come into contact with a second shear pin 558. The second shear pin 558 will block further downward movement of the tubular sleeve 520 during a fracturing operation.

Figure 5D:
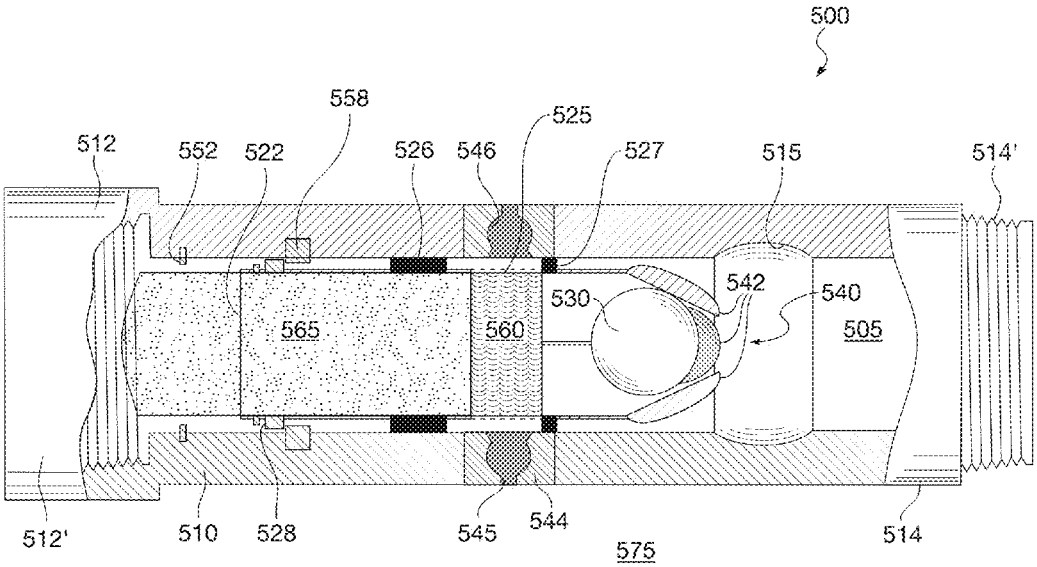

FIG. 5D is a fourth side view of the sliding sleeve 500. Here, a fracturing fluid 565 is being pumped down the bore 505 of the housing 510, under pressure. The fracturing fluid 565 is preferably a sand slurry that displaces any wellbore fluids or aqueous pumping fluids 560 residing in the wellbore. The shoulder 528 remains "shouldered out" against the second shear pin 558, with the second shear pin 558 having a shear rating that is greater than the formation parting pressure. Wellbore fluids 560 and fracturing fluid 565 will be forced into a surrounding formation 575.

Figure 5E:
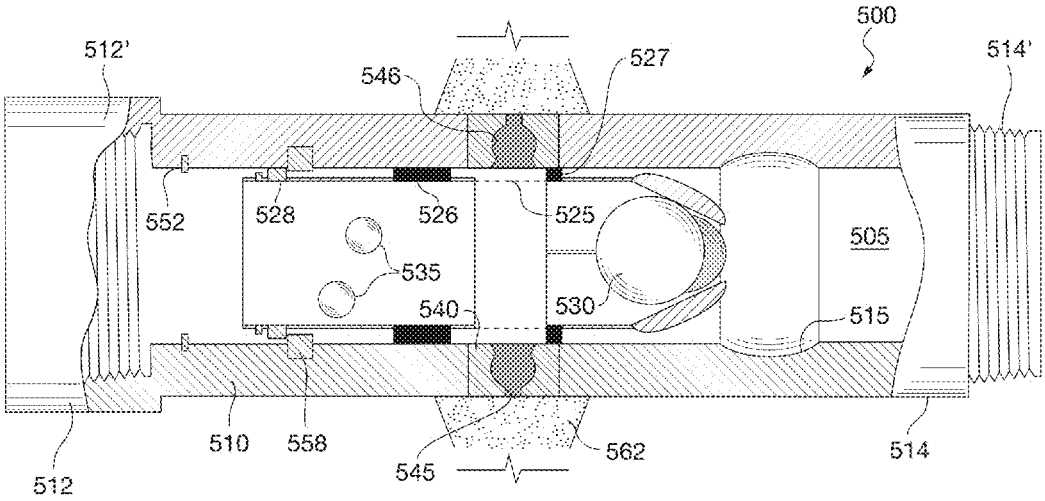

FIG. 5E is a next view of the sliding sleeve 500 in operation. Here, the fracturing fluid 565 is being injected through the ports 545 under high pressure and into the formation 575. The pressure exceeds a parting pressure of the formation 575. A fracture 562 is now being formed in the surrounding subsurface formation 575, emanating from the ports 545.

It can also be seen in FIG. 5E that ball sealers 535 are being pumped downhole towards the ports 515. The ball sealers 535 are dropped from the surface 401, and are sized to land in seats 546 along the ports 545.

Figure 5F:
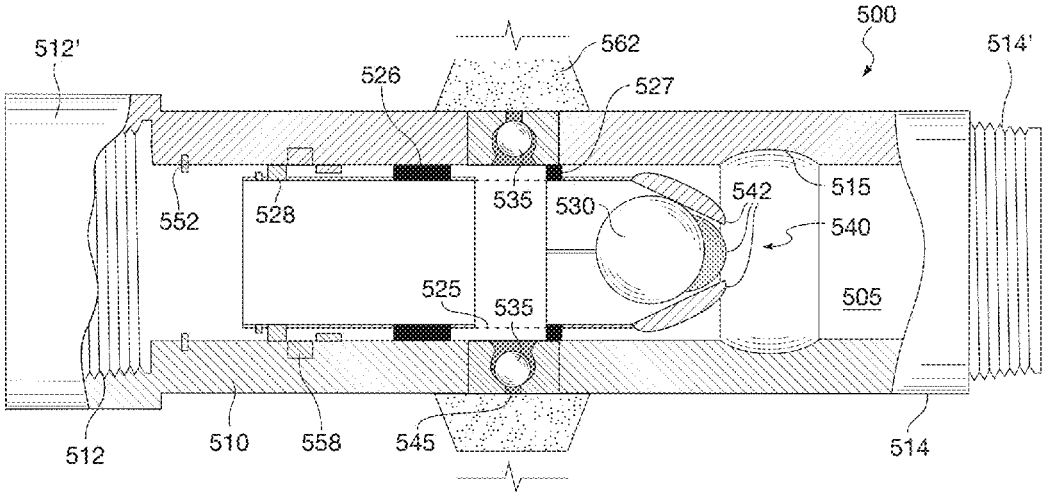

FIG. 5F is a sixth side view of the sliding sleeve 500. Here, the ball sealers 535 have landed securely in the seats 546 of the ports 545, aided by hydrostatic and pumping pressure. The ball sealers 535 are dimensioned to seal the ports 545 from further fluid flow. Additional fluid pumping from the surface (seen at 401 in FIG. 4) will now increase pressure in the wellbore and will act on the surface area defined by the shoulder 528.

Figure 5G:
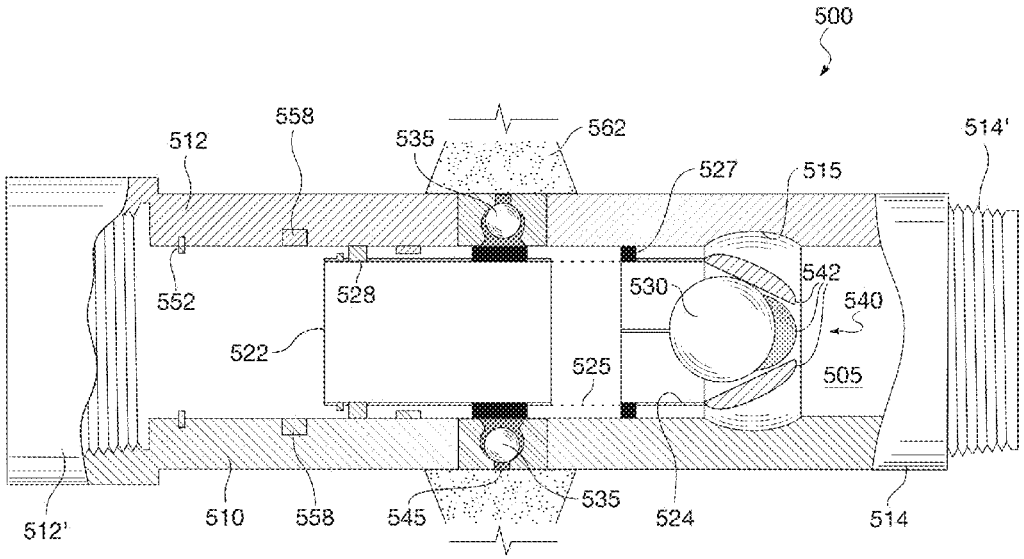

FIG. 5G is a next view of the sliding sleeve 500 in operation. Here, pressure has acted on the second shoulder 528, which in turn applies pressure to the second shear pin 558. As noted the second shear pin 558 resides along an inner diameter of the tubular housing 510. In FIG. 5G, the second shear pin 558 has been sheared in response to additional hydraulic pressure. This is considered to be a second degree of hydraulic pressure. This allows the tubular sleeve 520 to slide further down the bore 505 relative to the surrounding tubular housing 510. Seals 526 associated with the tubular sleeve 520 are now covering the ball sealers 535 and the ports 545.

Figure 5H:
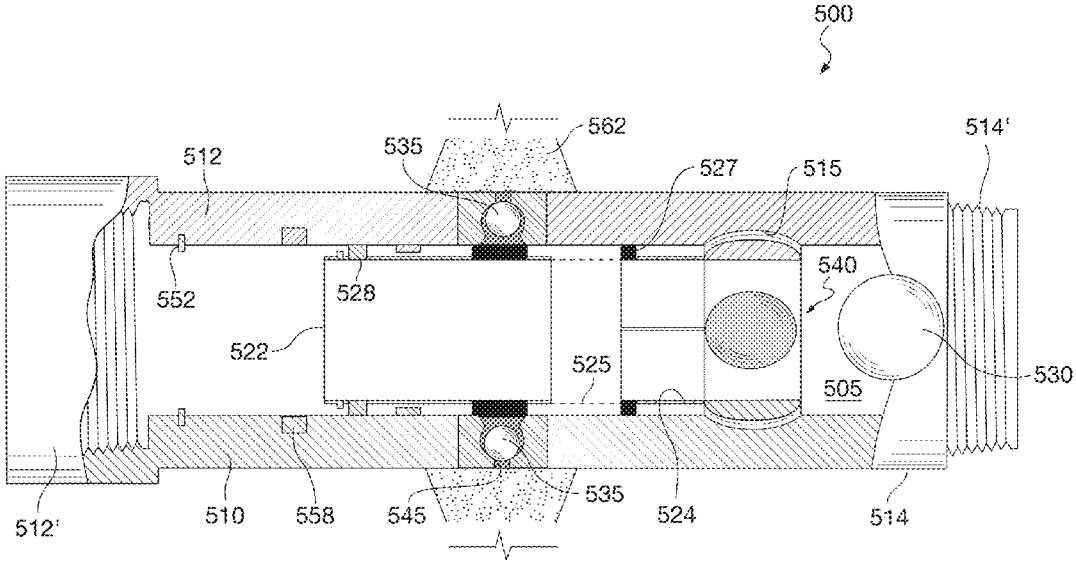

FIG. 5H presents a final side view of the sliding sleeve 500. Here, fluids have continued to be pumped from the surface 401 and into the wellbore. This increases hydraulic pressure on the ball 530 and seat 540. Fluid pressure has now forced the ball seat dogs 542 making up the seat 540 to open. This, in turn, releases the frac ball 530 from the sliding sleeve 500. Outer surfaces of the dogs 542 now reside in the circumferential recess 515 along the tubular housing 510. The ball 530 will then fall further in the wellbore, where it will encounter a seat associated with a next sliding sleeve that is identical to sleeve 500.

As noted, a plurality of sleeves 500 may be threadedly placed along a production liner. Using the sleeves 500, multiple zones (such as zones "A" through "J" shown in FIG. 4) may be fracture-treated in stages. FIGS. 6A through 6K present schematic views of a lower portion of a wellbore 600 demonstrating a staged completion. In these views, the wellbore 600 has been formed in a substantially horizontal orientation. The wellbore 600 has been lined with a string of production casing 630 and is undergoing a completion procedure. The procedure uses a series of sliding sleeves 500A, 500B, 500C, . . . 500H in accordance with the sliding sleeve 500 of FIG. 5A.

FIGS. 6A through 6K demonstrate the fracturing and "re-perforating" of zones along a wellbore 600 in stages. In each figure, a heel 622 of the wellbore 600 and a toe 624 of the wellbore 600 are shown. The wellbore 600 is lined with a string of production casing 630. The production casing 630 includes a horizontal portion 610. Multiple separate sliding sleeves 500A, 500B, 500C, . . . 500H have been placed along the horizontal portion 610. The wellbore 600 is ready for fracture stimulation treatment.

Figure 6A:
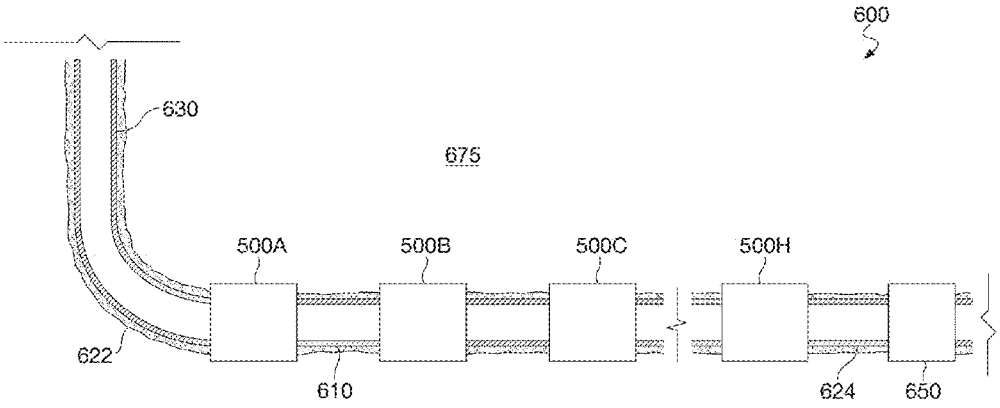
FIGS. 6A through 6K present a lower portion of a horizontal wellbore. The wellbore is being completed in a substantially horizontal orientation. The wellbore has been lined with a string of production casing and is fitted with a series of sliding sleeves in accordance with the sliding sleeve of FIG. 5A.

In FIG. 6A, the wellbore 600 actually shows five valves. The first four valves are valves 500A, 500B, 500C and 500H. It is understood that additional valves (500D, 500E, 500F and 500G are used intermediate valves 500C and 500H but are not shown. The last valve is valve 650, residing at the toe 524 of the wellbore 600. This valve 650 may be of any construction, and may be activated through hydraulic pressure, through an electrical signal, or through a ball-and-seat arrangement. Alternatively, valve 650 may simply be perforations shot at the toe 624 of the wellbore 600.

Figure 6B:
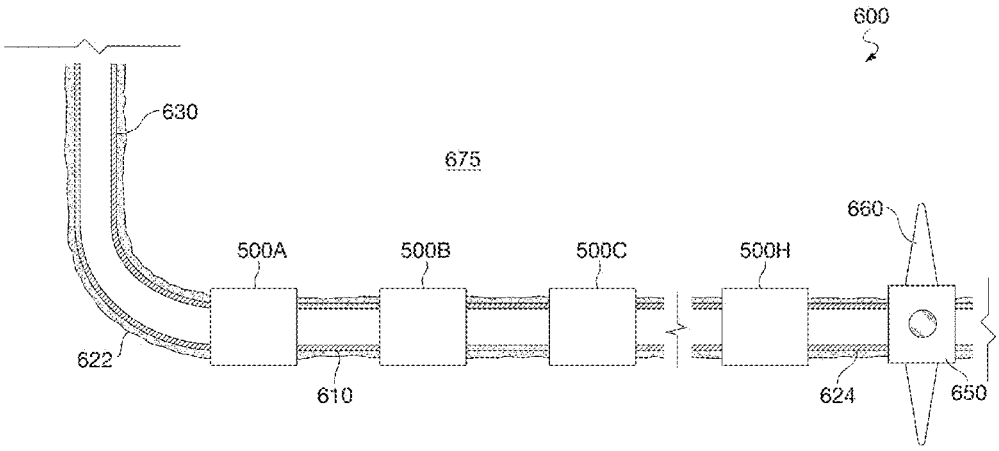

Moving to the next view, in FIG. 6B, the lower-most sleeve 650 is opened. No ball need be dropped to open this lower-most sleeve 650. Fluids are injected through the sleeve 650, under pressure, in order to open up the subsurface formation 675 at a lowest (or farthest) zone of interest along the casing 610. In one aspect, the sleeve 650 is a hydraulically actuated valve. This may be, for example, the Falcon Hydraulic Actuated Valve of Schlumberger limited, of Sugar Land, Tex. Alternatively, perforations are shot.

It can be seen in FIG. 6B that an aqueous fluid 660 has been pumped down the wellbore 600. The fluid 660 is being further pumped through the valve 650 and into the formation 675. In this way, the formation 675 is initially opened up at the toe 624.

Figure 6C:
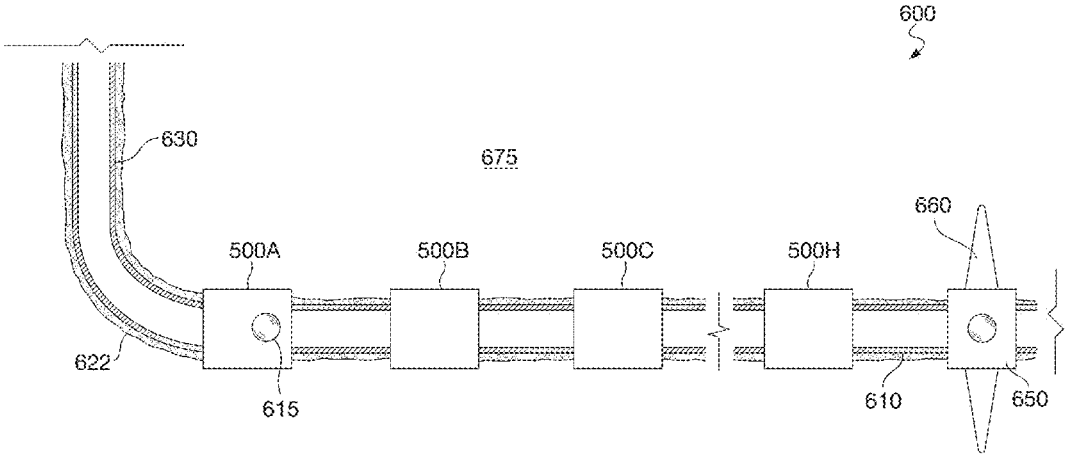

FIG. 6C shows a next step in the completion of the wellbore 600. Here, a fracturing ball 615 has been dropped into the wellbore 600. The ball 615 is pumped down until it lands on a seat associated with the first sleeve 500A in the series of sliding sleeves. This is in accordance with the steps shown in FIGS. 5A and 5B, above.

Figure 6D:
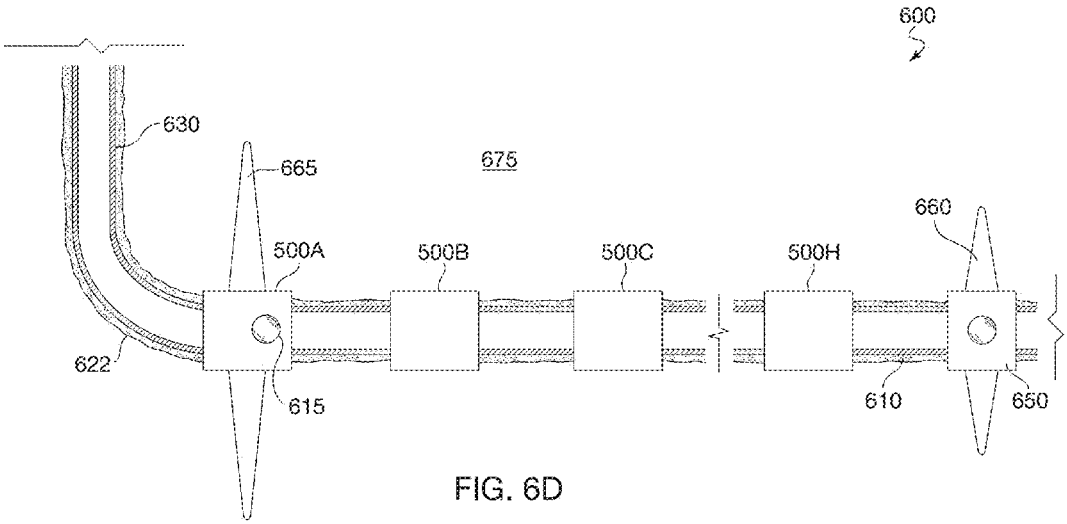

FIG. 6D shows still a next step in the completion of the wellbore 600. Here, a fracturing fluid 665 is pumped down the wellbore 600. This opens a port (analogous to port 545 of FIGS. 5B and 5C) along the first sleeve 500A. In FIG. 6D, hydraulic fracturing fluids are being pumped through ports exposed in the first sliding sleeve 500A. This is in accordance with the steps shown and described above in connection with FIGS. 5C, 5D and 5E. The result is that a zone adjacent to sleeve 500A has been perforated.

Figure 6E:
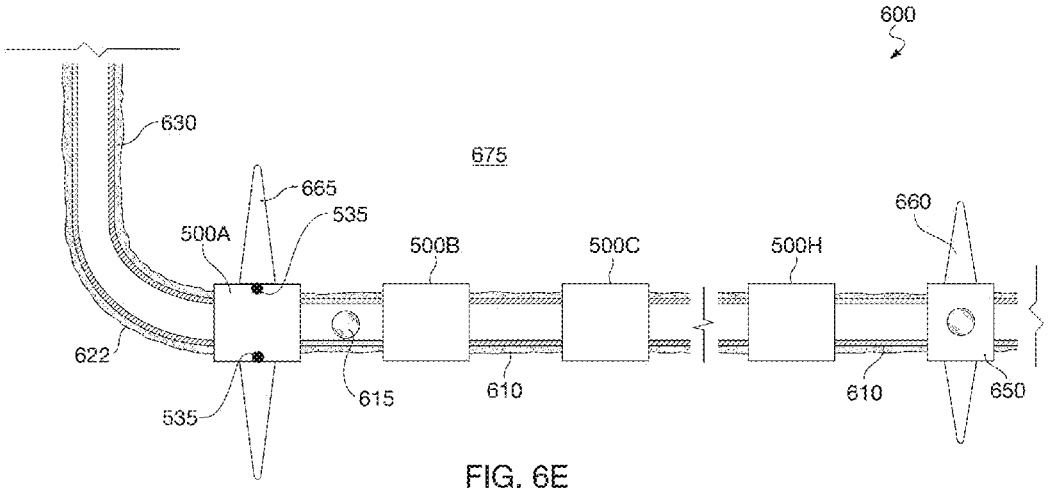

In FIG. 6E, the fracturing ball 615 has been forced off of the seat associated with the first sleeve 500A. The ball 615 is now being pumped down to the second sleeve 500B in the series of sliding sleeves. This is in accordance with the steps shown and described above in connection with FIGS. 5F, 5G and 5H. In addition, ball sealers 535 have been pumped down to the horizontal portion of the wellbore 600 and have landed in the ports (analogous to port 545 of FIG. 5B) of the first sleeve 500A. This is in accordance with the steps shown and described above in connection with FIGS. 5E and 5F.

Figure 6F:
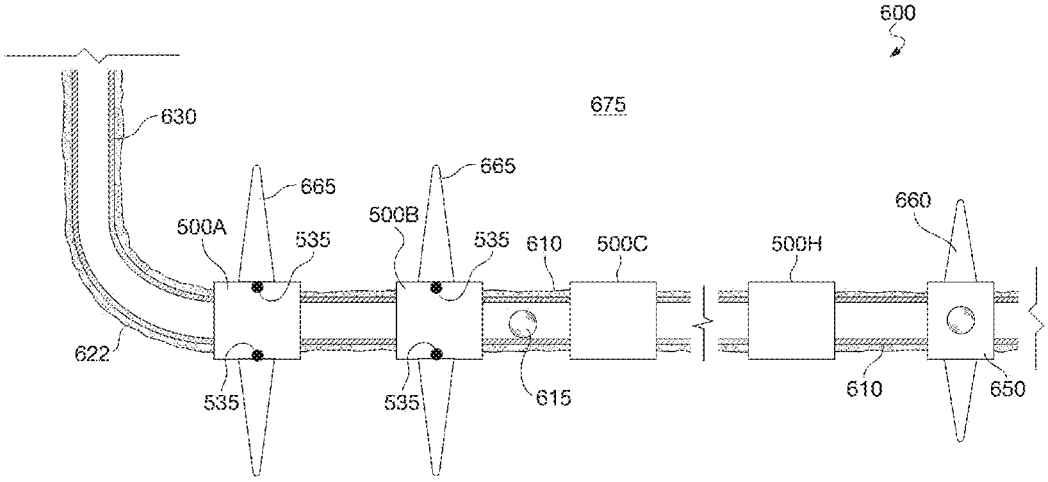

FIG. 6F presents the next step in the fracturing and completion of the wellbore 600. In FIG. 6F, the fracturing ball 615 has landed on a seat associated with the second sleeve 500B. Hydrostatic and pumping pressures have forced the second sleeve 500B to open. Hydraulic fracturing fluids have been pumped through ports exposed in the second sliding sleeve 500B. This is in accordance with the steps shown and described above in connection with FIGS. 5C, 5D and 5E, and FIG. 6D. The result is that a zone adjacent to sleeve 500B has been stimulated with a hydraulic fracture.

It is further observed that the fracturing ball 615 has been forced off of the seat associated with the second sleeve 500B. The ball 615 is now being pumped down to the third sleeve 500C in the series of sliding sleeves. This is in accordance with the steps shown and described above in connection with FIGS. 5G and 5H. In addition, ball sealers 535 have been pumped down to the horizontal portion 610 of the wellbore 600 and have landed in the ports (analogous to port 545 of FIG. 5B) of the second sleeve 500B. This is in accordance with the steps shown and described above in connection with FIGS. 5E and 5F.

Figure 6G:
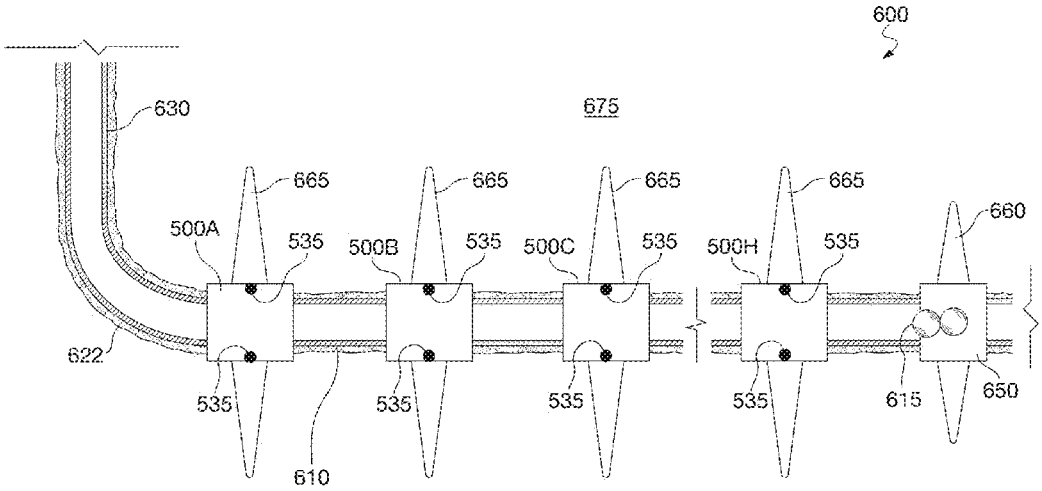

FIG. 6G shows that the same fluid pumping procedure has been performed relative to the third sleeve 500C as was shown in FIG. 6F for the second sleeve 500B. In addition, the same fluid pumping procedure has been performed relative to the fourth sleeve 500H (and to all intermediate sleeves 500D, 500E, 500F and 500G) as was shown in FIG. 6F for the second sleeve 500B. The result is that zones adjacent to sleeves 500D-500H have been stimulated with hydraulic fractures.

It is also noted that ball sealers 535 have been pumped down to the sleeves 500C-500H. All ports in all sleeves are now closed to the formation 675. This is in accordance with the steps shown and described above in connection with FIGS. 5E and 5F. The ball sealers 535 are secured in their seats (shown at 546 in FIG. 5G) and cannot fall out. The sleeves have been opened and then closed from heel 622 to toe 624. The frac ball has come to final rest on the sleeve 650.

It is now necessary to re-open the casing 610 to the formation 675. This may be done by perforating the casing 610 proximate each of the sleeves 500A-500H.

Figure 6H:
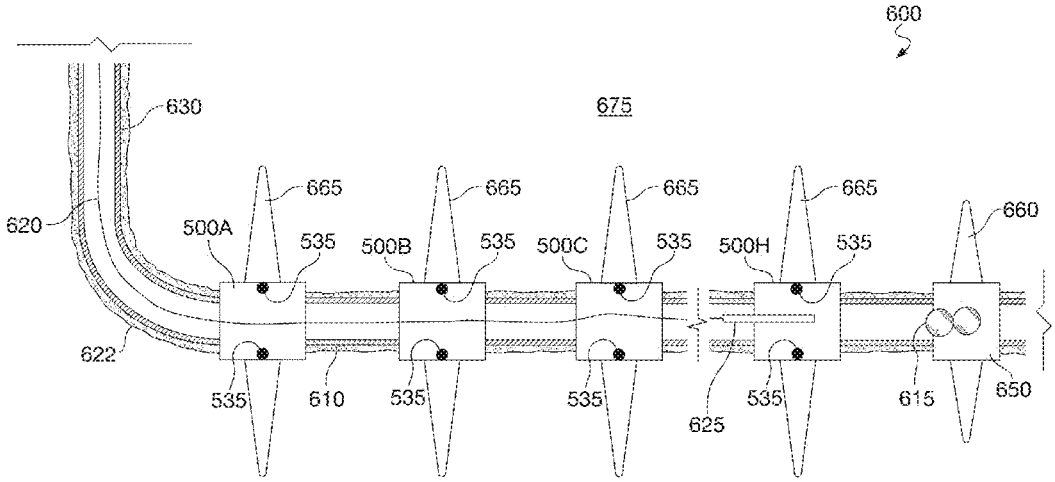

FIG. 6H shows that a perforating gun 625 has been run into the wellbore 600. The perforating gun 625 has been pumped in at the end of an electric line 620. Alternatively, the perforating gun 625 may delivered on a tractor inasmuch as diameter-restricting seats are not remaining in the sleeves 500A-500H. The perforating gun 625 is preferably a select fire gun that fires, for example, 16 shots. The gun has associated charges that detonate in order to cause shots to be fired from the gun into the surrounding production casing. Typically, the perforating gun 625 contains a string of shaped charges distributed along the length of the gun and oriented according to desired specifications. However, in the gun 625, the charges are not connected to a single detonating cord to ensure simultaneous detonation of all charges; instead, a series of cords, such as four cords, is provided to allow sequential signals. Examples of suitable perforating guns include the Frac Gun™ from Schlumberger, and the G-Force® from Halliburton.

Figure 6I:
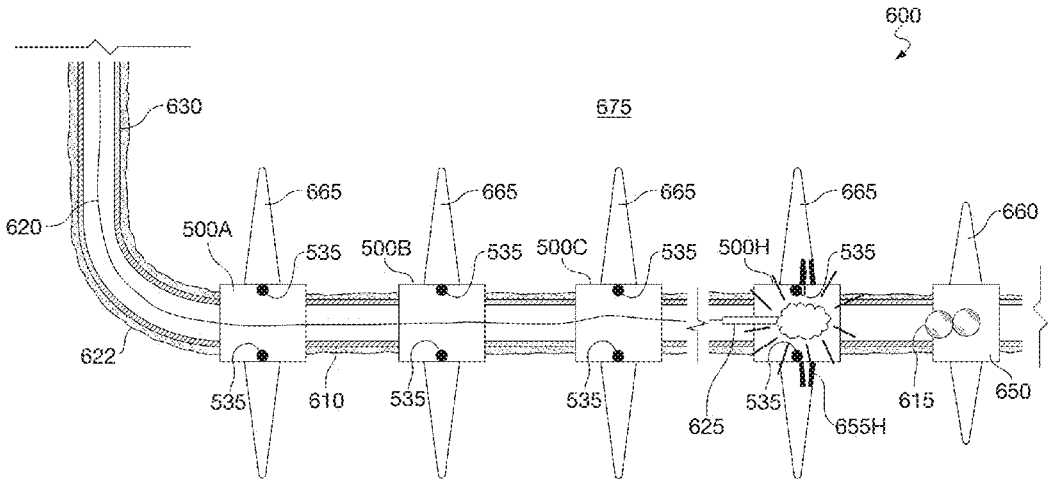

In FIG. 6I, charges associated with the perforating gun 625 have been detonated through sleeve 500H. Perforations 655H are now created through the sleeve 500H. This re-opens the production casing 630 to the subsurface formation 675 along the zone adjacent the illustrative final sliding sleeve 600H in the series of sleeves.

Figure 6J:
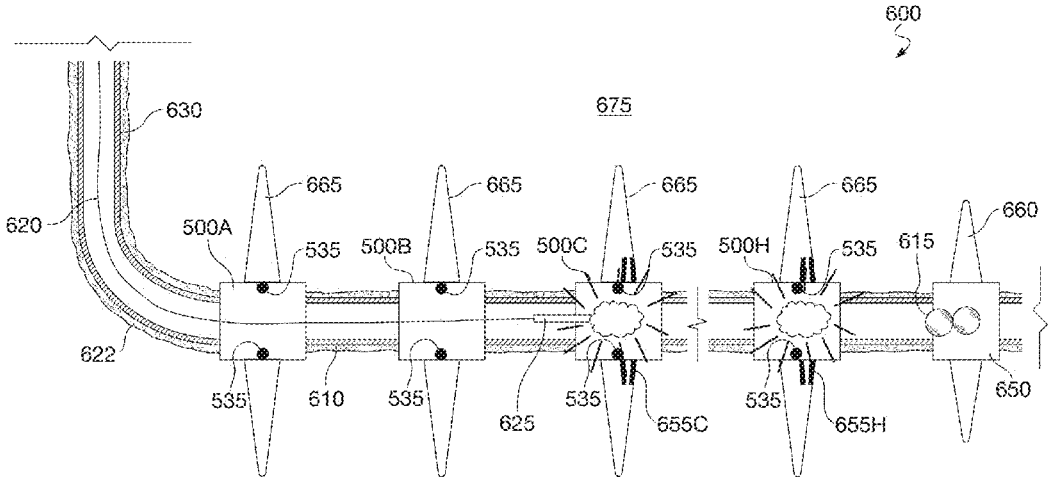

FIG. 6J shows that the perforating gun 625 has been pulled, or "raised," in the wellbore 600. The perforating gun 625 is now at the level of the third sleeve 500C in the series of sliding sleeves. A signal is sent to the perforating gun 625, causing shots to be fired at the level of the third sleeve 500C. This creates new perforations 655C and reopens the wellbore 600 to the subsurface formation 675 along the zone adjacent the third sliding sleeve 500C.

Figure 6K:
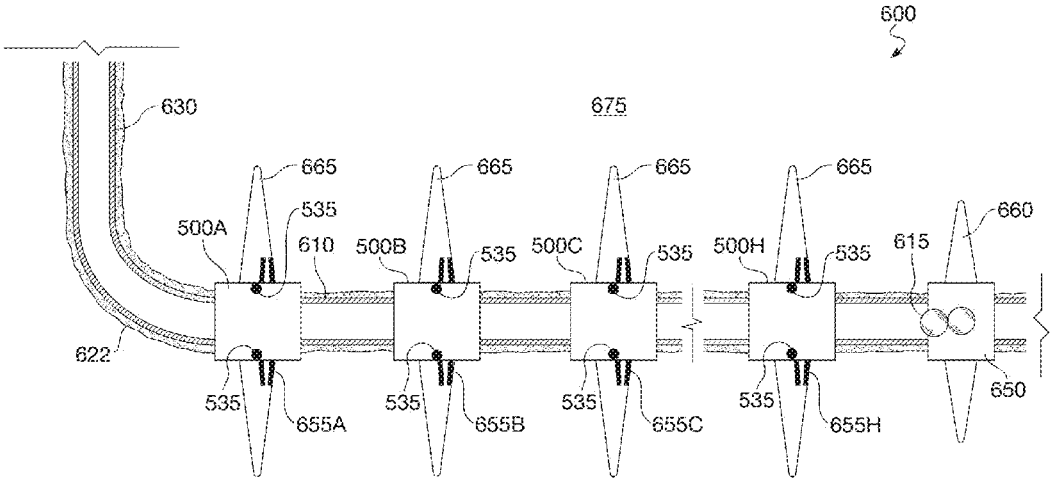

The process of pulling the electric line 620 to raise the perforating gun 625 to a next sleeve and then discharging the gun 625 to perforate the formation is repeated for each sleeve. FIG. 6K demonstrates that perforations have been formed adjacent each of the sleeves 500A-500H in the series of sliding sleeves. Perforations are provided at 655A-655H and the perforating gun 625 has been removed from the wellbore 600. The production casing 630 is now open to the subsurface formation 675 and is ready for production from multiple fractured zones.

Figure 7A:
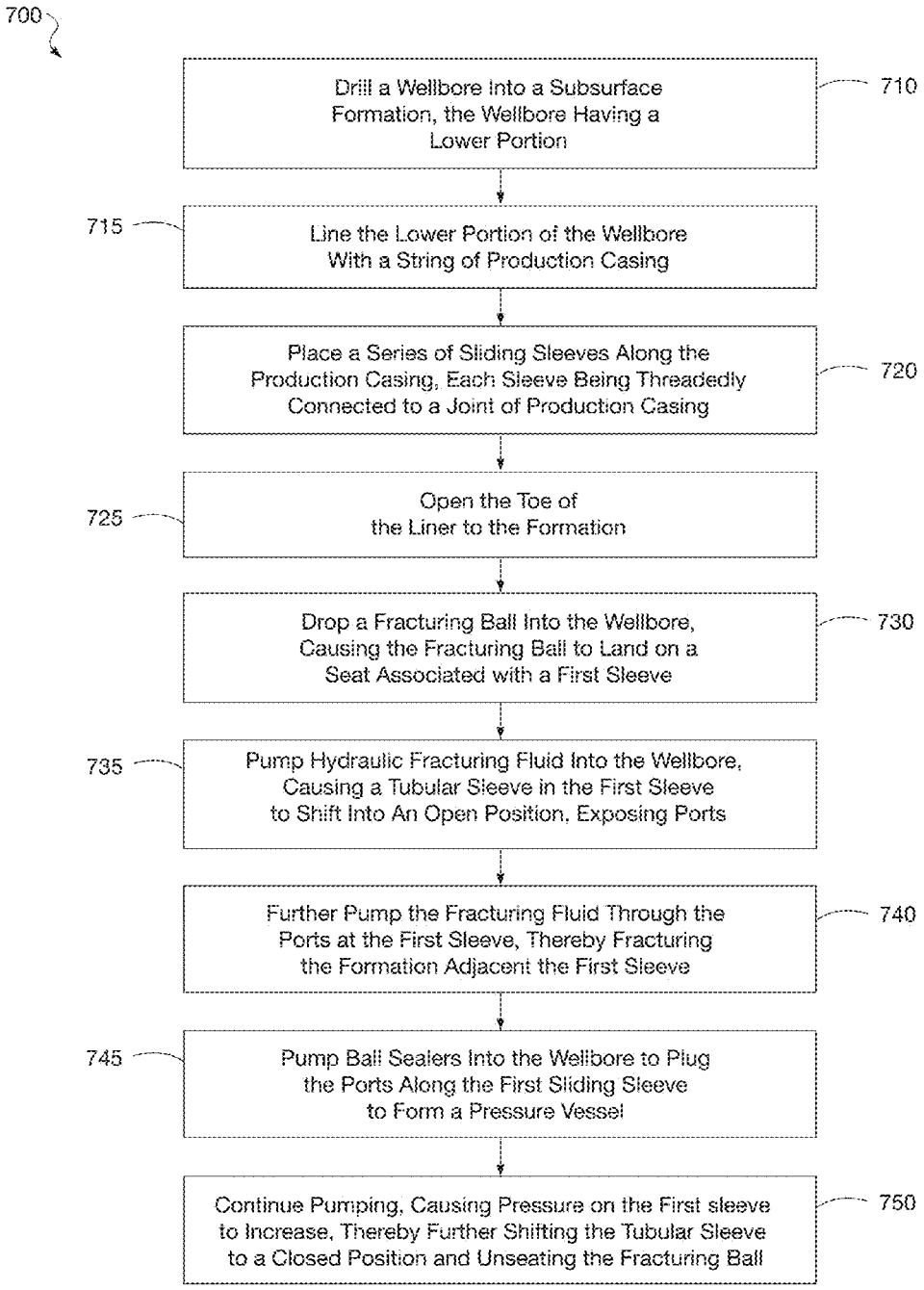
FIGS. 7A and 7B present a single flow chart showing steps for a method of completing a wellbore. The completion method involves perforating multiple zones using sliding sleeves in accordance with the sliding sleeve of the FIG. 5 series of drawings.
Figure 7B:
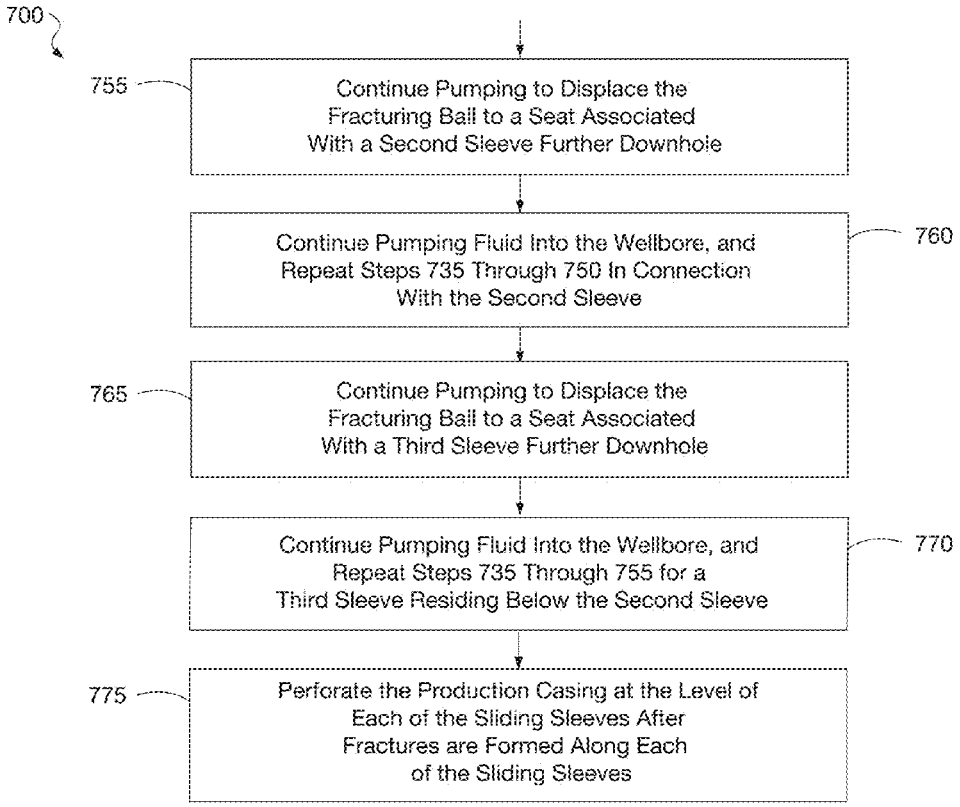

The procedure described above using the novel sliding sleeve 500 can be generally presented in flow chart form. FIGS. 7A and 7B represent a flow chart showing steps for a method 700 for completing a well in a subsurface formation, in one embodiment.

The method 700 first includes forming a wellbore. This is shown at Box 710. The wellbore defines a bore that extends into a subsurface formation. The wellbore may be formed as a substantially vertical well; more preferably, the well is drilled as a deviated well or, even more preferably, a horizontal well. Where the wellbore is completed horizontally, it will have a heel and a toe.

The method 700 next includes lining a lower portion of the wellbore with a string of production casing. This is provided at Box 715. The production casing is made up of a series of steel pipe joints that are threadedly connected, end-to-end, along at least the horizontal portion of the wellbore. The production casing may be a liner string.

The method 700 further includes placing a series of sliding sleeves along the production casing. This is indicated at Box 720. Each sliding sleeve has a tubular housing threadedly connected at opposing ends to joints of the production casing. This means that the steps of Boxes 715 and 720 are contemporaneous. In this way, each sliding sleeve resides along the subsurface formation in series with the casing. The sleeves are configured and designed according to the sliding sleeve described above.

The method 700 also includes opening the toe of the liner to the formation. This is provided at Box 725. Opening the toe may mean perforating and fracturing the casing at the toe of the well. Alternatively, this may mean activating a sleeve to expose ports at the toe.

The method 700 additionally comprises dropping a fracturing ball into the wellbore. This is shown at Box 730. Thereafter, a hydraulic fluid is pumped into the wellbore, thereby causing the ball to land on a seat associated with a first sleeve of the series of sliding sleeves at the heel of the lateral wellbore. Preferably, the hydraulic fluid is an aqueous slurry comprising a proppant.

The method 700 also includes continuing to pump the hydraulic fluid until a tubular sleeve associated with the first sliding sleeve slides. This is seen at Box 735. In accordance with the sliding sleeve design described above, this takes place when a first shear pin connecting the tubular sleeve to the tubular housing is sheared. Shearing the first shear pin allows the tubular sleeve to slide down the tubular housing in response to hydraulic pressure applied to the ball. The sleeve slides until the openings along the tubular housing are generally aligned with the one or more ports along the tubular housing. This exposes the ports along the tubular housing of the first sleeve.

The operator continues to pump the hydraulic fluid through the ports in the first sleeve. This is seen at Box 740. This further pumping creates fractures in the subsurface formation.

The method 700 further comprises dropping one or more ball sealers into the wellbore. This is shown at Box 745. In this embodiment, pumping additional hydraulic fluid into the wellbore further causes the one or more ball sealers to seal corresponding ports in the first sleeve. This forms a pressure vessel in the tool.

It is observed that the present invention need not be limited to the use of ball sealers to form a pressure vessel. Modification of the sliding sleeve may enable the use of a diverting agent, a shear-thickening fluid, darts, collar rings, etc.

The method 700 next includes continuing to pump fluids from the surface. This will cause pressure to rise as the ball sealers landed on the ports form a closed pressure vessel. The increased pressure causes a second shear pin to shear, thereby further releasing the tubular sleeve, shifting the sleeve to a closed position. This is provided in Box 750.

The fluid pressure acting on the seat also causes the first seat to release the ball so that the ball drops further down the wellbore. In other words, a biasing force acting against the seat is overcome, allowing the ball to be released through the first sleeve. This is provided in Box 755. As described above in connection with FIGS. 5G and 5H, the sliding sleeve is arranged such that ball seat retracts into recesses machined into an inner diameter of the housing. The fracturing ball then drops down to a next sleeve in the series of sleeves.

Of interest, as the tubular sleeve slides along the tubular housing in response to the hydraulic pressure, the first elastomeric seal covers the one or more ports and the ball sealers residing in the corresponding one or more ports. This beneficially prevents the ball sealers from dropping out of the ports during later completion operations.

The method 700 further comprises continuing to pump the hydraulic fluid into the wellbore. Fluid is pumped under pressure until a tubular sleeve associated with the second sliding sleeve slides. This is seen at Box 760. This exposes ports along the tubular housing of the second sleeve to the formation. The steps of Boxes 735 through 750 are repeated in connection with the second sleeve.

In one optional embodiment, the step of continuing to pump in Box 755 is conducted after recognizing a condition of screen-out while pumping the hydraulic fluid through the ports in the first sleeve. The condition of screen-out is remediated by the step of exposing ports along the tubular housing of the second sleeve, and the immediate volumetric expansion of the pressure vessel defined by the production liner and frac ball, which occurs as soon as the frac ball is released from a seat.

The operator at the surface will recognize that a condition of screen-out has occurred by observing the surface pumps. In this respect, pressure will quickly build in the wellbore, producing rapidly climbing pressure readings at the surface. The operator will then hope that he can flow back the well, using bottom hole pressure to try and push the proppant-laden slurry back out of the well and to the surface. If the velocity is not sufficient, the proppant will drop out in the casing and across the heel of the well, creating a bridge of proppant that must be removed mechanically before operations can continue.

The method 700 next includes continuing to pumping the hydraulic fluid to displace the fracturing ball from the seat in the second sleeve. This is presented at Box 765. The ball is then pumped down to a new seat associated with a third sliding sleeve. The third sliding sleeve is located closer to the toe of the well than the second sliding sleeve.

The method 700 next includes repeating the steps of Boxes 735 through 755 for the third sliding sleeve. This is provided in Box 770. This process may also be repeated for fourth, fifth, and multiple additional sliding sleeves further downhole.

The method additionally includes perforating the production casing at the level of the sliding sleeves. This is seen at Box 775. This step is performed after fractures have been formed in the subsurface formation along all sleeves. In this way, the bore of the production casing is exposed to the subsurface formation and wellbore fluids. Subject to the installation of production tubing and any suitable packers, and subject to any final wellbore or formation cleanout or acid stimulation, production operations may then commence.

As can be seen, an apparatus and improved method for fracture stimulating a wellbore along multiple zones are provided herein. The apparatus represents a sliding sleeve having a seat that receives a frac ball, allowing the wellbore to be pressured up in order to slide a sleeve and expose ports for fracturing the formation along a first zone. The seat then releases the ball so that a next sleeve may receive the same ball on a seat at a second zone. Multiple zones may be fracture stimulated from the top down using a series of sliding sleeve devices, and using the same fracturing ball.

Beneficially, the wellbore is ready to go on-line for production after all sleeves are actuated and the formation has been fractured along all corresponding zones without need of flow-back or the drilling out of balls and seats. Additionally, for a given liner size, every sliding sleeve in the series of sleeves is manufactured to the same interchangeable specifications, thereby simplifying field operations and reducing complexity. Still further, the wellbore is completed without diameter restrictions caused by multiple and progressively smaller seats. The same ball may be used to activate every sliding sleeve.

While it will be apparent that the inventions herein described are well calculated to achieve the benefits and advantages set forth above, it will be appreciated that the inventions are susceptible to modification, variation and change without departing from the spirit thereof.

What is claimed is:

1. A method of completing a well in a subsurface formation, comprising:

lining at least a lower portion of a wellbore with a string of production casing;

placing a series of sliding sleeves along the production casing, with each sliding sleeve including a tubular housing threadedly connected at opposing ends to joints of the production casing so as to reside along a subsurface formation and each tubular housing including one or more ports along the tubular housing, and each sliding sleeve including a tubular sleeve comprising a pair of first and second elastomeric seals connected to the tubular sleeve and residing in an annular region between the tubular sleeve and the tubular housing, each of the pair of first and second elastomeric seals straddling one or more openings along the tubular sleeve;

dropping a fracturing ball into the wellbore;

pumping a hydraulic fluid into the wellbore, thereby causing the ball to land on a seat associated with a first sleeve of the series of sliding sleeves;

continuing to pump the hydraulic fluid until the tubular sleeve associated with the first sliding sleeve slides a first portion, thereby exposing the one or more ports along the tubular housing of the first sleeve and aligning the one or more ports with the one or more openings along the tubular sleeve;

pumping the hydraulic fluid through the one or more openings and the one or more ports in the first sliding sleeve, thereby creating fractures in the subsurface formation adjacent the first sliding sleeve;

increasing pumping pressure, thereby causing the first sliding sleeve to slide from the first portion to a second portion along the tubular housing until the first elastomeric seal of the pair of elastomeric seals covers the one or more ports and further increasing pressure within the first sliding sleeve to cause the first seat to release the ball so that the ball drops further down the wellbore;

pumping additional hydraulic fluid into the wellbore, thereby causing the ball to land on a seat associated with a second sliding sleeve of the series of sliding sleeves further downhole;

continuing to pump the hydraulic fluid into the wellbore until a tubular sleeve associated with the second sliding sleeve slides the first portion, thereby exposing one or more ports along a tubular housing of the second sleeve;

pumping the hydraulic fluid through the one or more openings and the one or more ports in the second sliding sleeve, thereby creating fractures in the subsurface formation adjacent the second sliding sleeve; and again increasing pumping pressure, thereby causing the second sliding sleeve to slide from the first portion to the second portion along the tubular housing until the first elastomeric seal of the pair of elastomeric seals covers the one or more ports and further increasing pressure within the second sliding sleeve to cause the second seat to release the ball so that the ball drops still further down the wellbore.

2. The method of claim 1, further comprising:

disposing the production casing along the lower portion of the wellbore in the subsurface formation in a substantially horizontal orientation;

a horizontal portion of the production casing comprises a heel and a toe; and the method further comprises opening the production casing to the formation along the toe.

3. The method of claim 2, further comprising:

increasing pumping pressure, thereby causing the first seat to release the ball so that the ball drops further down the wellbore, is conducted after recognizing a condition of screen-out while pumping the hydraulic fluid through the one or more ports in the first sliding sleeve; and remediating the condition of screen-out by exposing one or more ports along the tubular housing of the second sliding sleeve.

4. The method of claim 2, wherein the hydraulic fluid is a slurry comprising a fracturing proppant.

5. The method of claim 2, further comprising:

after the step of creating fractures in the subsurface formation adjacent the first sliding sleeve, dropping one or more ball sealers into the wellbore so that the one or more ball sealers seals corresponding ports in the first sleeve, thereby forming a pressure vessel in the first sliding sleeve; and after the step of creating fractures in the subsurface formation adjacent the second sliding sleeve, dropping one or more ball sealers into the wellbore so that the one or more ball sealers seals corresponding ports in the second sleeve, thereby forming a pressure vessel in the second sliding sleeve.

6. The method of claim 5, further comprising providing each sliding sleeve with components including:

the tubular housing;

the one or more ports placed along the tubular housing;

the tubular sleeve residing within the tubular housing, with the tubular sleeve being held concentrically in place along the housing by a first shear pin;

the one or more openings along the tubular sleeve;

the seat, with the seat being disposed proximate a lower end of the tubular sleeve and sized to sealingly receive the ball; and a second shear pin residing in an annular region between the tubular sleeve and the surrounding housing.

7. The method of claim 6, further comprising exposing the one or more ports along the tubular housing of a sliding sleeve by shearing the first shear pin, causing the tubular sleeve to slide down the tubular housing in response to fluid pressure applied to the ball until openings along the tubular housing are generally aligned with the one or more ports along the tubular housing.

8. The method of claim 7, wherein each sliding sleeve further comprises:

providing a shoulder residing in the annular region between the tubular sleeve and the surrounding tubular housing, the shoulder being configured to rest against the second shear pin to align the openings along the tubular housing with the one or more ports along the tubular housing in response to the first fluid pressure; and providing a recess along an inner diameter of the tubular housing, the recess residing below the one or more ports.

9. The method of claim 8, further comprising:

providing the seat with at least two collet fingers extending from the tubular sleeve, and connected dogs, wherein the dogs are biased in a closed and overlapping position, creating a fluid flow barrier in the wellbore;

causing the seat to release the ball comprises overcoming a biasing force such that the dogs are opened and the fluid flow barrier is removed; and causing the seat to release the ball further comprises causing the shoulder to shear the second shear pin at a second fluid pressure, thereby allowing the tubular sleeve to slide further along the tubular housing until the opened dogs are expanded into the recess along the tubular housing, and allowing the ball to be released to a next sleeve in the series of sleeves.

10. The method of claim 9, further comprising:

securing the second shear pin to the inner diameter of the tubular housing;

securing the shoulder to an outer diameter of the tubular sleeve.

11. The method of claim 8, further comprising:

determining a formation parting pressure of the subsurface formation;

ensuring that the first shear pin of each of the series of sliding sleeves is designed to shear at the first fluid pressure, which is lower than the formation parting pressure; and ensuring that the second shear pin of each of the series of sliding sleeves is designed to shear at the second fluid pressure, which is greater than the formation parting pressure.

12. The method of claim 1, further comprising:

perforating the production casing at a level of the second of the series of sliding sleeves.

13. The method of claim 1, further comprising:

perforating the production casing at the level of each of the sliding sleeves in the series of sliding sleeves.

14. A sliding sleeve for a downhole completion operation, comprising:

a tubular housing having a first end and a second end, each end being configured to threadedly connect to joints of production casing;

one or more ports disposed at a location along the tubular housing;

a tubular sleeve residing concentrically within a bore of the tubular housing;

a plurality of radially disposed ball seat dogs extending from a lower end of the tubular sleeve, wherein the ball seat dogs are biased to collapse into the bore of the tubular housing, thereby forming a seat for receiving a fracturing ball;

a first shear pin proximate the first end of the tubular sleeve, securing the tubular sleeve to the tubular housing proximate a first end of the tubular housing, wherein the shear pin is configured to shear in response to a first degree of hydraulic pressure applied to a ball when the ball has landed on the seat, thereby permitting the tubular sleeve to slide along the tubular housing in a direction of the second end of the tubular housing;

one or more openings along the tubular sleeve intermediate a first end and a second end of the tubular sleeve; and elastomeric seals disposed within an annular region formed between the tubular sleeve and the surrounding tubular housing, straddling the one or more openings wherein the tubular sleeve is configured so that when the tubular sleeve slides further along the tubular housing in response to a second degree of hydraulic force, the first elastomeric seal covers the one or more ports;

and wherein:

the one or more openings are sized and arranged to reside adjacent the one or more ports when the tubular sleeve slides towards the second end of the tubular housing in response to the first degree of hydraulic pressure; and the ball seat dogs are configured to open and to release the ball from the sliding sleeve in response to a second degree of hydraulic pressure that is greater than the first degree of hydraulic pressure.

15. The sliding sleeve of claim 14, wherein the one or more ports are sized to receive a respective ball sealer.

16. The sliding sleeve of claim 15, further comprising:

a second shear pin residing in the annular region between the sleeve and the surrounding housing;

a shoulder residing in the annular region between the sleeve and the surrounding housing, the shoulder being configured to serve as a stop against the second shear pin when the opening along the tubular housing is aligned with the one or more ports along the tubular housing and a recess along an inner diameter of the tubular housing, the recess residing below the one or more ports proximate the second end of the tubular housing, the recess dimensioned to receive outer surfaces of the ball seat dogs when the dogs are opened in response to the second degree of hydraulic pressure and after the tubular sleeve slides along the tubular housing.

17. The sliding sleeve of claim 16, wherein:

the seat comprises two or more collett fingers, each of which supports a respective ball seat dog, and wherein the dogs are biased in a closed and overlapping position.

18. The sliding sleeve of claim 17, wherein:

the second shear pin is secured to an inner diameter of the tubular housing;

a shear catch is secured to an outer diameter of the tubular sleeve; and the sleeve further comprises first and second elastomeric seals connected to the tubular sleeve and residing in the annular region, the elastomeric seals straddling the openings along the tubular sleeve.

19. The sliding sleeve of claim 18, wherein:

the first degree of hydraulic pressure is lower than a parting pressure of a surrounding formation; and the second degree of hydraulic pressure is greater than the formation parting pressure.

* * * * *